US008886072B2

(12) United States Patent
Iwasaki

(10) Patent No.: US 8,886,072 B2
(45) Date of Patent: Nov. 11, 2014

(54) PWM GENERATING UNIT, IMAGE FORMING APPARATUS, AND IMAGE FORMING METHOD

(71) Applicant: Hiroyuki Iwasaki, Kanagawa (JP)

(72) Inventor: Hiroyuki Iwasaki, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 27 days.

(21) Appl. No.: 13/735,234

(22) Filed: Jan. 7, 2013

(65) Prior Publication Data

US 2013/0177331 A1 Jul. 11, 2013

(30) Foreign Application Priority Data

Jan. 10, 2012 (JP) ..... 2012-002571

(51) Int. Cl.
*G03G 15/00* (2006.01)
*G03G 15/02* (2006.01)
*G03G 15/06* (2006.01)

(52) U.S. Cl.
CPC ..... *G03G 15/5004* (2013.01); *G03G 15/065* (2013.01)
USPC ..... 399/88; 399/50; 399/55

(58) Field of Classification Search
CPC ..... G03G 15/5004; G03G 2215/00978
USPC ..... 399/49, 50, 55, 88, 89
See application file for complete search history.

(56) References Cited

U.S. PATENT DOCUMENTS

| | | | | |
|---|---|---|---|---|
| 6,122,460 | A * | 9/2000 | Meece et al. | 399/50 X |
| 2006/0002745 | A1 | 1/2006 | Iwasaki | |
| 2007/0059041 | A1 | 3/2007 | Iwasaki | |
| 2008/0056741 | A1 | 3/2008 | Iwasaki | |
| 2009/0290894 | A1 * | 11/2009 | Iwata | 399/69 |
| 2010/0008689 | A1 | 1/2010 | Iwasaki et al. | |
| 2010/0028028 | A1 | 2/2010 | Iwasaki | |
| 2010/0247128 | A1 * | 9/2010 | Sakata | 399/88 X |
| 2012/0201552 | A1 | 8/2012 | Hirai et al. | |

FOREIGN PATENT DOCUMENTS

| | | |
|---|---|---|
| JP | 09-062042 | 3/1997 |
| JP | 2007-060865 | 3/2007 |
| JP | 2012-163645 | 8/2012 |

* cited by examiner

*Primary Examiner* — Sandra Brase
(74) *Attorney, Agent, or Firm* — IPUSA, PLLC

(57) ABSTRACT

A PWM generating unit may include a base duty setting register configured to store a base duty value that is set thereto, and a PWM generator to obtain a corrected duty value by correcting the base duty value based on first correction data and second correction data, and to generate a PWM signal according to the corrected duty value. The first correction data may be computed from a rotation period of a first rotational body, and the second correction data may be computed from a rotation period of a second rotational body.

15 Claims, 15 Drawing Sheets

FIG.5

| | FOR 100% SOLID IMAGE PATTERN | FOR 50% SOLID IMAGE PATTERN | WAVEFORM AT THE TIME OF CORRECTION |
|---|---|---|---|
| DEVELOPING BIAS | CONSTANT | CORRECTION BIAS OF INVERTED PHASE FROM DENSITY NON-UNIFORMITY | CORRECTION BIAS OF INVERTED PHASE FROM DENSITY NON-UNIFORMITY |
| CHARGING BIAS | CONSTANT | CONSTANT | CORRECTION BIAS OF SAME PHASE AS DENSITY NON-UNIFORMITY |
| DENSITY NON-UNIFORMITY | | | CONSTANT |

PWM GENERATING UNIT, IMAGE FORMING APPARATUS, AND IMAGE FORMING METHOD

CROSS-REFERENCE TO RELATED APPLICATIONS

This application is based upon and claims the benefit of priority of the prior Japanese Patent Application No. 2012-002571, filed on Jan. 10, 2012, the entire contents of which are incorporated herein by reference.

BACKGROUND OF THE INVENTION

1. Field of the Invention

The present invention relates to a PWM generating unit for generating a PWM (Pulse Width Modulation) signal according to a duty value, an image forming apparatus, an image forming method, and an image forming system.

2. Description of the Related Art

In a prior art image forming apparatus using the electrophotography method, a toner image is adhered on a photoconductive body by utilizing an electric field caused by a potential difference between a developing roller and the photoconductive body. It is generally known that this electric field varies depending on a developing gap, that is, the distance between the photoconductive body and the developing roller. The variation in the developing gap may be generated due to rotary fluctuation of the photoconductive body or rotary fluctuation of the developing roller. The rotary fluctuation may be caused by at least one of an unstable rotation of a motor or the like that rotates the photoconductive body or the developing roller, an eccentricity of the photoconductive body or the developing roller, an error in a mounting position of the photoconductive body or the developing roller, and the like. When the developing gap varies, non-uniformity of a density of the image (hereinafter referred to as "density non-uniformity") occurs.

Because the density non-uniformity of the image due to the variation in the developing gap is caused by the rotary fluctuation of the photoconductive body or the rotary fluctuation of the developing roller, the density non-uniformity of the image occurs periodically and may easily be confirmed visually. Hence, in the prior art, measures are taken to suppress the density non-uniformity of the image due to the variation in the developing gap.

For example, a Japanese Laid-Open Patent Publication No. 9-62042 proposes a technique to comprehensively reduce stripe shaped density non-uniformity generated periodically in the image, in an image forming apparatus employing the electrophotography method or the static recording method. In addition, a Japanese Laid-Open Patent Publication No. 2007-60865 proposes a technique to correct a rotational speed of a rotary body by detecting the variation in the rotational speed of the rotary body.

However, the prior art may store density variation data for every image forming condition in a storage unit, for example, and correct the density non-uniformity using the stored density variation data. According to this method, in the case of a full-color image forming apparatus, for example, the density variation data are required for every color, and the storage unit needs to have a large storage capacity.

In addition, the prior art may read the density variation data within a short time during the image formation, and carry out a process by a CPU (Central Processing Unit) to correct the density non-uniformity. Consequently, a processing load on the CPU increases, and in some cases, a dedicated CPU may be required exclusively for the correction of the density non-uniformity.

SUMMARY OF THE INVENTION

Accordingly, it is a general object in one embodiment of the present invention to provide a novel and useful PWM generating unit, image forming apparatus, image forming method, and image forming system, in which the problem described above may be suppressed.

Another and more specific object in one embodiment of the present invention is to provide a PWM generating unit, an image forming apparatus, an image forming method, and an image forming system, which may correct the density non-uniformity with a reduced processing load.

According to one aspect of the present invention, a PWM generating unit to generate a PWM signal according to a duty value may include a base duty setting register configured to store a base duty value that is set thereto; and a PWM generator configured to obtain a corrected duty value by correcting the base duty value based on first correction data and second correction data, and to generate a PWM signal according to the corrected duty value, wherein the first correction data is computed from a rotation period of a first rotational body, and the second correction data is computed from a rotation period of a second rotational body.

According to another aspect of the present invention, an image forming apparatus may include the PWM generating unit described above.

According to still another aspect of the present invention, an image forming method may use the PWM generating unit described above in the image forming apparatus described above, and may utilize correction data received from an external apparatus.

Other objects and further features of the present invention will be apparent from the following detailed description when read in conjunction with the accompanying drawings.

BRIEF DESCRIPTION OF THE DRAWINGS

FIG. 5 is a diagram illustrating examples of patterns of density non-uniformity, developing biases, and charging biases;

DESCRIPTION OF THE PREFERRED EMBODIMENTS

Figure 1:
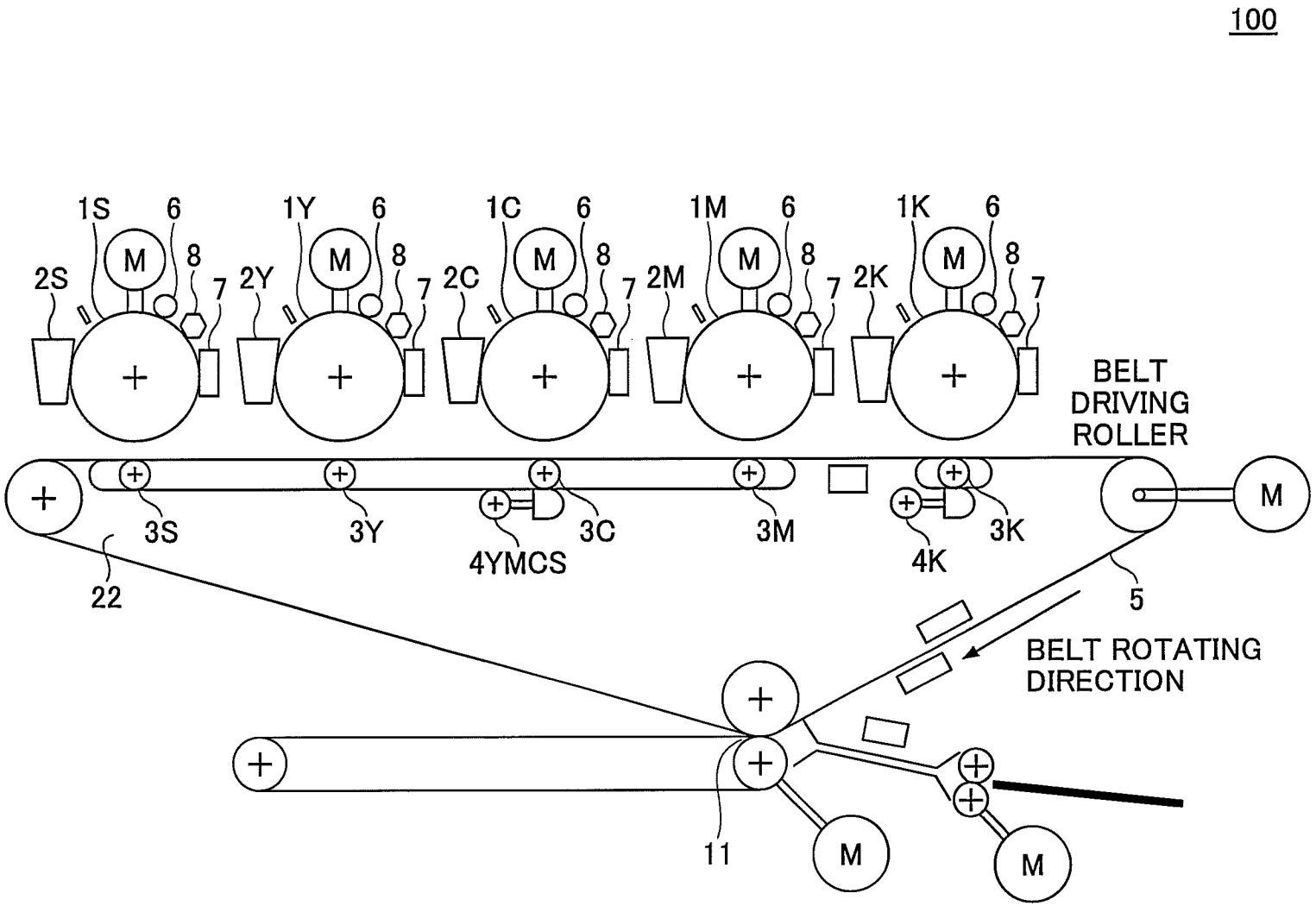
FIG. 1 is a diagram schematically illustrating functions related to an image formation in an image forming apparatus in a first embodiment.

A description will be given of embodiments of the PWM generating unit, the image forming apparatus, the image forming method, and the image forming system according to the present invention, by referring to the drawings.

First Embodiment

A description will be given of a first embodiment of the present invention. FIG. 1 is a diagram schematically illustrating functions related to an image formation in the image forming apparatus in the first embodiment.

An image forming apparatus 100 in this first embodiment may include a plurality of photoconductive bodies 1Y, 1C, 1M, 1K, and 1S (each hereinafter simply referred to as a "photoconductive body 1" when not referring to a specific photoconductive body). The photoconductive body 1 is an example of a first rotational body. Developing units 2Y, 2C, 2M, 2K, and 2S (each hereinafter simply referred to as a "developing unit 2" when not referring to a specific developing unit), and transfer units 3Y, 3C, 3M, 3K, and 3S (each hereinafter simply referred to as a "transfer unit 3" when not referring to a specific transfer unit) are respectively provided with respect to each photoconductive body 1. In the image forming apparatus 100, each photoconductive body 1 is uniformly charged by a charging unit 6, and laser light corresponding to an image of each color scans to expose the charged photoconductive body 1 at a predetermined timing by a laser write unit (not illustrated) based on an image signal, to thereby form an electrostatic latent image on each photoconductive body 1. A single-color toner image is formed on each photoconductive body 1 by the developing unit 2, and the photoconductive bodies 1 make contact with an intermediate transfer belt 5 in order to transfer the single-color toner images formed on the photoconductive bodies 1 onto the intermediate transfer belt 5. The intermediate transfer belt 5 is driven to rotate at a predetermined speed, so that toner images of four colors are successively transferred onto the intermediate transfer belt 5 to form an overlapping (or superimposed) color image. The overlapping color image is transferred onto a transfer sheet, such as paper, by a secondary transfer unit 11 in a single transfer, to thereby form a full-color image on the transfer sheet.

In the image forming apparatus 100 in this embodiment, the transfer units 3Y, 3C, 3M, 3K, and 3S raise and lower the intermediate transfer belt 5 at a transfer position of each image on each photoconductive body 1, so that the intermediate transfer belt 5 makes contact with each photoconductive body 1. The transfer unit 3 is raised and lowered by variably driving engaging and disengaging mechanisms 4YMCS and 4K, in order to make the intermediate transfer belt 5 make contact with each photoconductive body 1 when raised by an engaging operation of the engaging and disengaging mechanisms 4YMCS and 4K, and to make the intermediate transfer belt 5 separate from each photoconductive body 1 when lowered by a disengaging operation of the engaging and disengaging mechanisms 4YMCS and 4K.

In addition, in the image forming apparatus 100 in this embodiment, a cleaning unit 7, a discharge unit 8, and the like are provided around each photoconductive body 1, in order to clean the residual toner remaining on each photoconductive body 1 and to discharge each photoconductive body 1.

Figure 2:
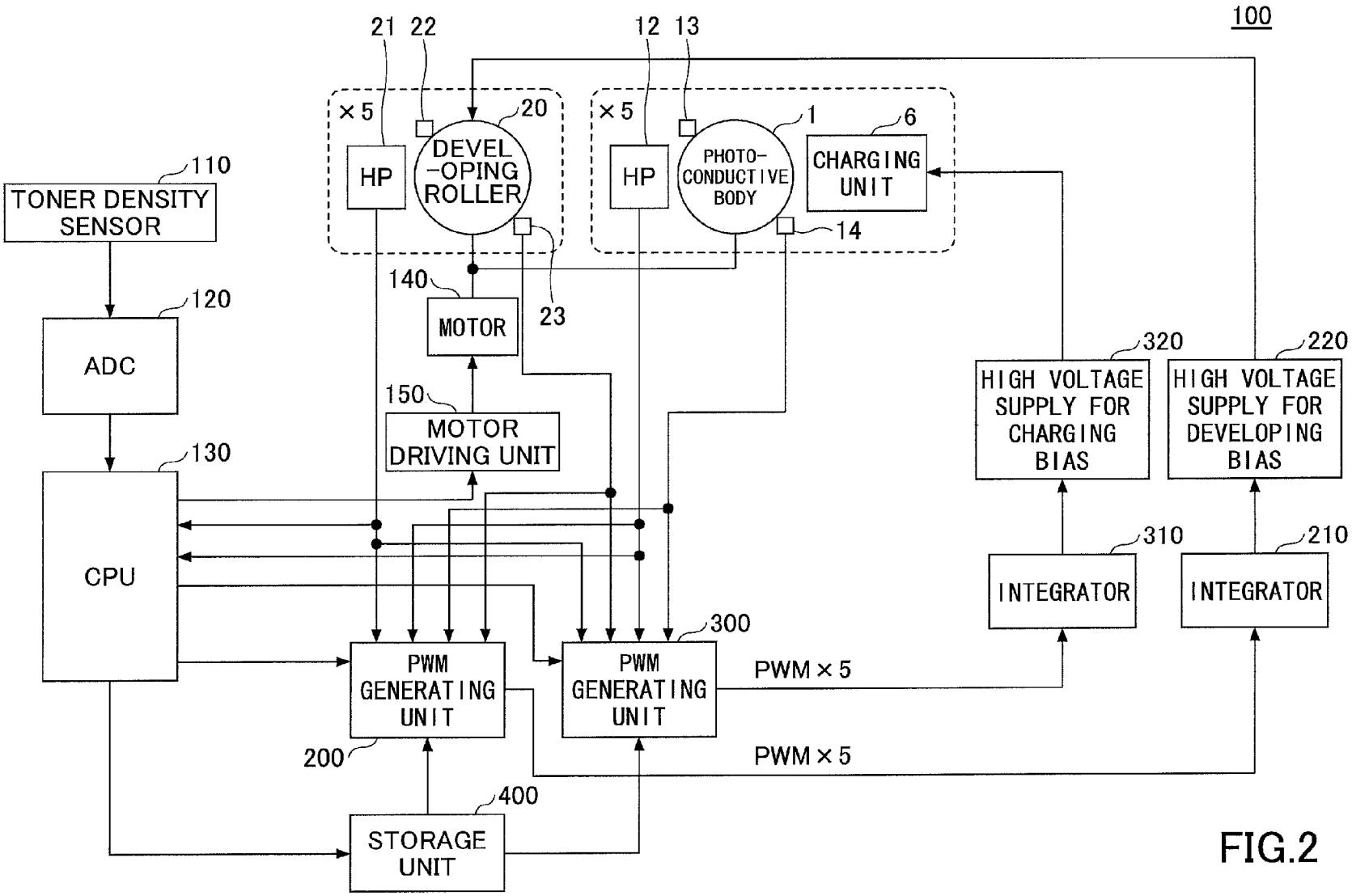
FIG. 2 is a diagram illustrating a functional structure of the image forming apparatus in the first embodiment.

Next, a description will be given of a functional structure of the image forming apparatus 1 in this embodiment, by referring to FIG. 2. FIG. 2 is a diagram illustrating the functional structure of the image forming apparatus in the first embodiment.

The image forming apparatus 100 in this embodiment may include a toner density sensor 110, an ADC (Analog-to-Digital Converter) 120, a CPU (Central Processing Unit) 130, a motor 140, a motor driving unit 150, PWM (Pulse Width Modulation) generators 200 and 300, integrators 210 and 310, a high voltage supply (or power supply) 220 for developing bias, a high voltage supply (or power supply) 320 for charging bias, and a storage unit 400.

In addition, the image forming apparatus 100 in this embodiment may include a HP (Home Position) sensor 12 to detect a rotary reference position of the photoconductive body 1, and rotary encoders 13 and 14 provided on an axis (or rotary shaft) of the photoconductive body 1. The image forming apparatus 100 in this embodiment may further include an HP sensor 21 to detect a rotary reference position of a developing roller 20 provided within the developing unit 2, and rotary encoders 22 and 23 provided around an axis (or rotary shaft) of the developing roller 20. The developing roller 20 is an example of a second rotational body.

The toner density sensor 110 in this embodiment may detect a toner density within the developing unit 2. The ADC 120 may sample an output of the toner density sensor 110, and supply a digital value to the CPU 130. The CPU 130 may detect a density non-uniformity of the toner, based on the data from the ADC 12. In addition, the CPU 130 may compute correction data for the density non-uniformity, based on a pb HP signal (or position) output from the HP sensor 12 of the photoconductive body 1 and a dr HP signal (or position) output from the HP sensor 21 of the developing roller 20. The computed correction data may be output from the CPU 130 and stored in the storage unit 400. For example, the storage unit 400 in this embodiment may be realized by a non-volatile memory and the like. A detailed description on the computation of the correction data will be given later in the specification.

Further, the CPU 130 in this embodiment may set the correction data to the PWM generating units 200 and 300, and control the motor driving unit 150 for driving the motor 140 that rotates the developing roller 20 and the photoconductive body 1.

The PWM generating unit 200 may generate a PWM signal having a duty value that is corrected based on the correction data stored in the storage unit 400 and the HP signals, and output the generated PWM signal to the integrator 210. The integrator 210 may output a voltage value. The integrator 210 may integrate the PWM signal, and output the voltage value to the high voltage supply 220 for the developing bias. The high voltage supply 220 for the developing bias may apply a bias voltage to the developing roller 20, according to the voltage value output from the integrator 210. In the following description, the bias voltage applied to the developing roller 20 may also be referred to as a developing bias.

The PWM generating unit 300 may generate a PWM signal having a duty value that is corrected based on the correction data stored in the storage unit 400 and the HP signals, and output the generated PWM signal to the integrator 310. The integrator 310 may output a voltage value. The integrator 310 may integrate the PWM signal, and output the voltage value to the high voltage supply 320 for the charging bias. The high voltage supply 320 for the charging bias may apply a bias voltage to the charging unit 6, according to the voltage value output from the integrator 310. In the following description, the bias voltage applied to the charging unit 6 may also be referred to as a charging bias.

Although FIG. 2 illustrates only one photoconductive body 1, one charging unit 6, and one developing roller 20, a plurality of photoconductive bodies 1, a plurality of charging units 6, and a plurality of developing rollers 20 are provided in correspondence with each of the colors. Similarly, the HP sensor 12 and the rotary encoders 13 and 14 are provided in each of the plurality of photoconductive bodies 1, and the HP sensor 21 and the rotary encoders 22 and 23 are provided in each of the plurality of developing rollers 20.

Figure 3A:
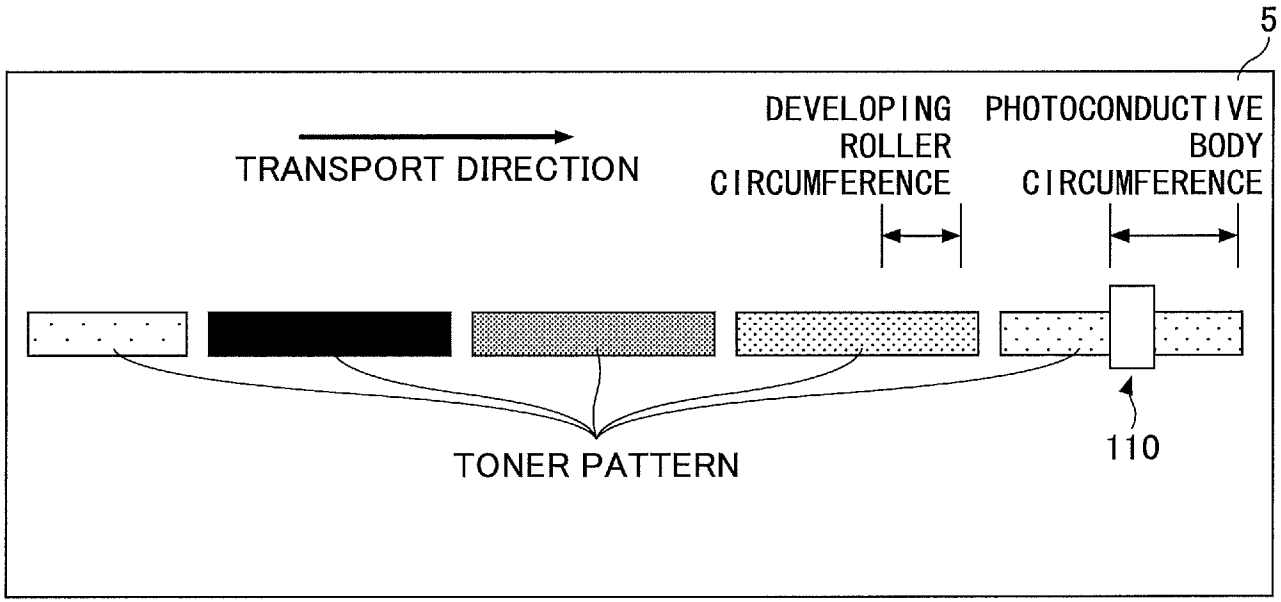
FIGS. 3A and 3B are diagrams for explaining detection of density non-uniformity.
Figure 3B:
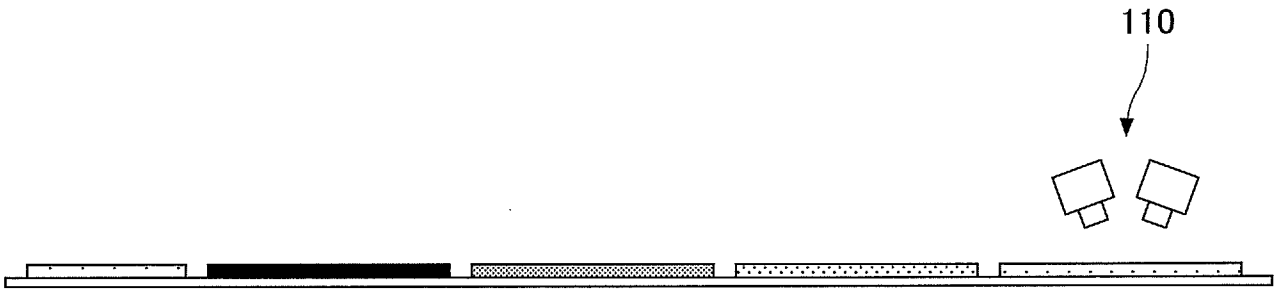

Next, a description will be given of the detection of the density non-uniformity in this embodiment, by referring to FIGS. 3A and 3B. FIGS. 3A and 3B are diagrams for explaining the detection of the density non-uniformity. FIG. 3A is a top view of a density detecting pattern formed on the intermediate transfer belt 5, and FIG. 3B is a side view of the density detecting pattern formed on the intermediate transfer belt 5.

In this embodiment, a toner pattern (or solid image pattern) for detecting the density non-uniformity of each color may be transferred onto the intermediate transfer belt 5, as illustrated in FIG. 3A. In this state, the charging bias and the developing bias are assumed to be constant (or fixed). The toner patterns of each of the colors may include a yellow toner pattern, a cyan toner pattern, a magenta toner pattern, a black toner pattern, a clear toner pattern, and the like, for example.

In this embodiment, the toner pattern is band-shaped, for example, and has a length amounting to at least one revolution (or circumference) of the photoconductive body 1. The density of the toner pattern may be detected by illuminating the toner pattern with light from the toner density sensor 110, and obtaining an output value proportional to the density based on reflected light from the toner pattern.

However, the toner pattern may be detected using a 100% solid image band pattern and a halftone (50%) band pattern. An output value of the toner density sensor 110 may be sampled at predetermined time intervals, and one revolution of the photoconductive body 1 may be segmented at detection timings of the rotary reference position of the photoconductive body 1 based on the pb HP signal from the HP sensor 12, and one revolution of the developing roller 20 may be segmented at detection timings of the rotary reference position of the developing roller 20 based on the dr HP signal from the HP sensor 21. The density non-uniformity from the rotary reference position of the photoconductive body 1 and the rotary reference position of the developing roller 20 may be acquired, in order to compute the correction data. When approximating the correction data by a sinusoidal wave, the correction data may include amplitude values of the sinusoidal wave and phase lag values from the respective rotary reference positions.

This embodiment employs the quadrature detection, and uses the amplitude and phase of the density non-uniformity obtained from the 100% solid image band pattern and the amplitude and phase of the density non-uniformity obtained from the halftone band pattern, in order to compute the correction data for the developing bias and the correction data for the charging bias.

Figure 4:
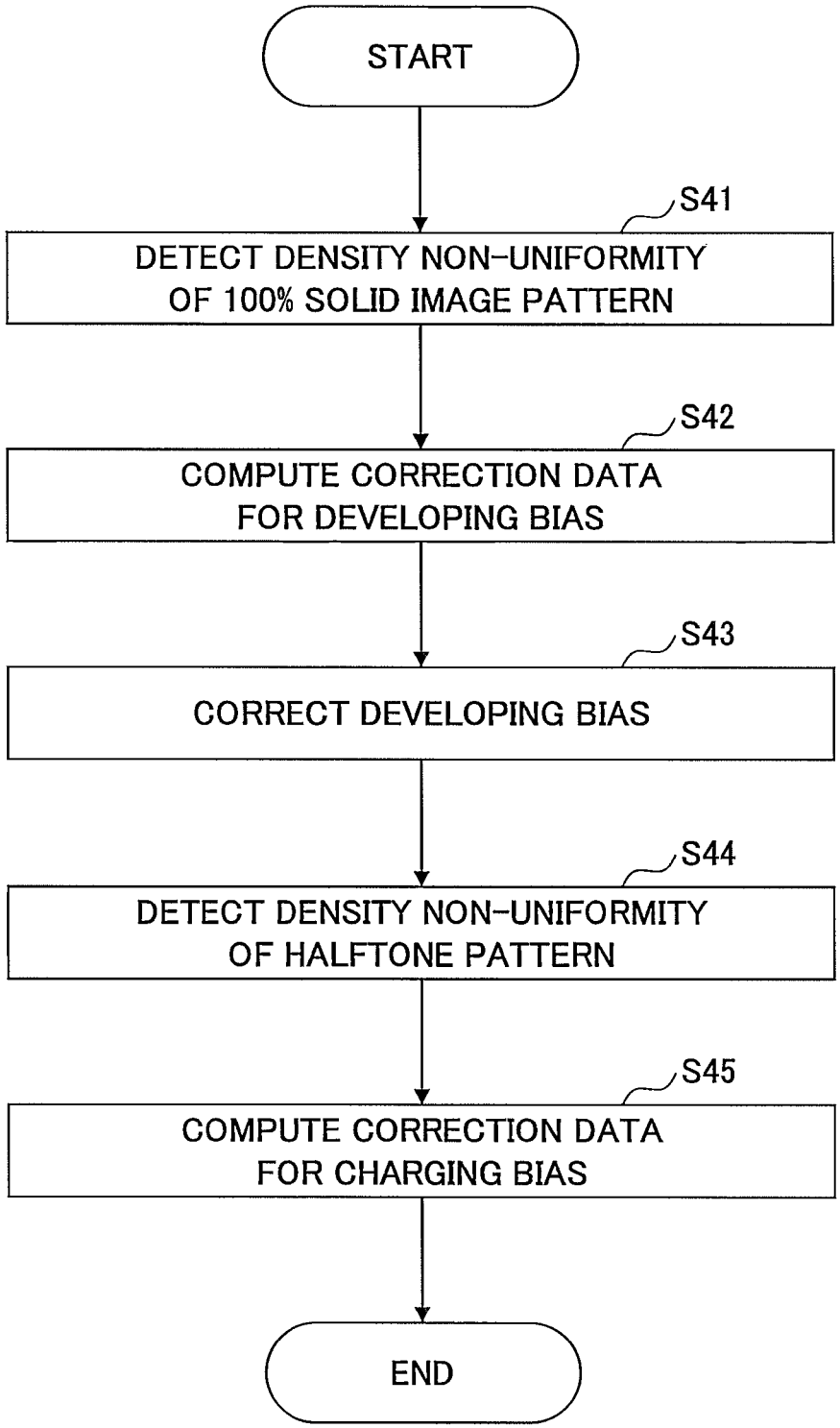
FIG. 4 is a flow chart for explaining the computation of the density non-uniformity.

Next, a description will be given of the computation of the correction data, by referring to FIG. 4. FIG. 4 is a flow chart for explaining the computation of the density non-uniformity.

In this embodiment, the 100% solid image band patterns may first be formed, and the density non-uniformities of these patterns may be detected (step S41). Because the density non-uniformity cannot be detected for black using the 100% solid image band pattern, an 80% solid image band pattern may be formed, and the density non-uniformity of this 80% solid image band pattern may be detected.

Next, in this embodiment, the correction data for the developing bias may be computed for the colors yellow, cyan, magenta, and clear, using the density non-uniformities detected from the 100% solid image band patterns (step S42). Then, in this embodiment, the duty value of the PWM signal supplied from the integrator 210 may be corrected by a technique that will be described later, using the correction data for the developing bias, in order to correct the developing bias (step S43).

Next, in this embodiment, the halftone band pattern may be formed, using the corrected developing bias, and the density non-uniformity of this pattern may be detected (step S44). Then, in this embodiment, the correction data for the charging bias may be computed for all of the colors, using the density non-uniformity detected from the halftone band pattern (step S45).

FIG. 5 is a diagram illustrating examples of patterns of the density non-uniformity, the developing biases, and the charging biases.

In this embodiment, the amplitude value of the developing bias may be computed from a density versus developing bias characteristic that indicates a proportional relationship. By applying the developing bias to the developing unit 20 so that the phase lag value has an inverted phase with respect to the phase of the density non-uniformity of the 100% solid image band pattern (80% solid image band pattern for black), the density non-uniformity of the 100% solid image pattern may be canceled.

The density non-uniformity may be canceled by simply correcting the developing bias with respect to the solid image band pattern, however, in the case of a band pattern other than the solid image band pattern, such as the halftone band pattern, for example, a difference [(charging bias)−(developing bias)] varies, to thereby generate the density non-uniformity. Hence, the developing bias may be corrected using the correction data for the developing bias, and the density non-uniformity of the halftone band pattern may be detected, in order to compute the correction data for the charging bias. In other words, the detected density non-uniformity of the halftone band pattern may be used to compute the correction data for the charging bias with respect to all of the colors.

The density non-uniformity detected from the halftone band pattern may have the inverted phase with respect to the phase of the density non-uniformity detected from the 100% solid image band pattern. This is because, when a developing electric field created by {(charging bias)−(developing bias)} is a halftone pattern, a change in the developing electric field affects the density non-uniformity. Hence, when the charging bias applied to the charging unit 6 is controlled to have an inverted phase with respect to the developing bias and to have the same phase as the density non-uniformity, the density non-uniformity may be canceled. The amplitude value of the charging bias may be computed from the density versus charging bias characteristic that indicates a proportional relationship.

The detection points of the density non-uniformity in this embodiment may be the position of the toner density sensor 110 set above the intermediate transfer belt 5. For this reason, the developing bias to be applied to the developing roller 20 and the charging bias to be applied to the charging unit 6 may need to respectively take into consideration the time it takes for a developing position and a charging position to reach the toner density sensor 110 (that is, the layout of the toner density sensor 110).

Figure 6:
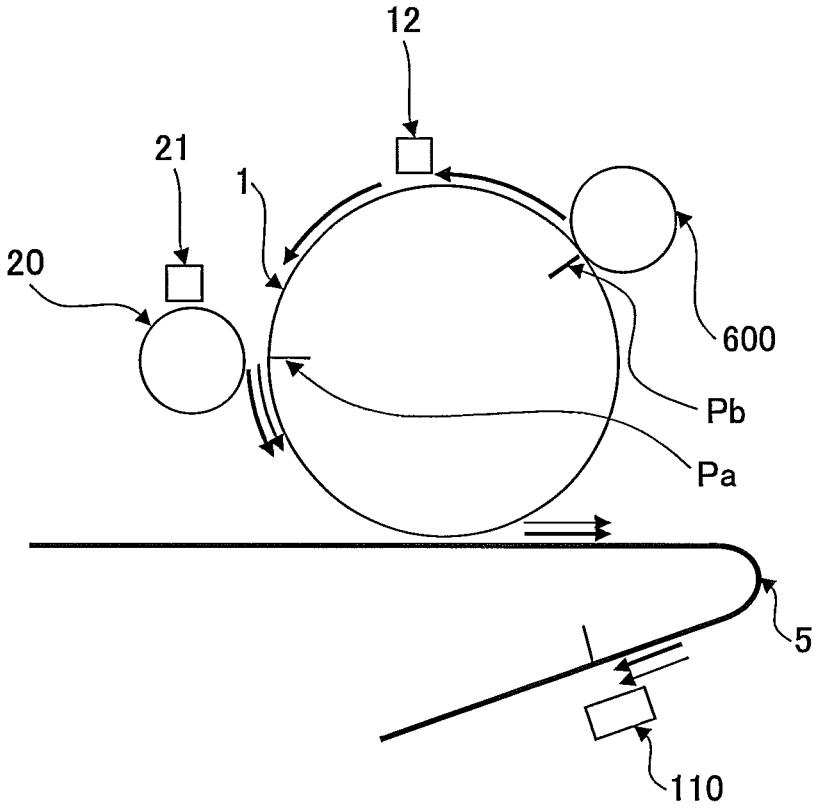
FIG. 6 is a diagram for explaining a charging position and a developing position.

FIG. 6 is a diagram for explaining the charging position and the developing position. In the case of the developing bias, the above described time to be taken into consideration may be the time it takes for an image at a developing position Pa illustrated in FIG. 6 to reach the position of the toner density sensor 110. On the other hand, in the case of the charging bias, the above described time to be taken into consideration may be the time it takes for an image at a charging position Pb illustrated in FIG. 6 to reach the position of the toner density sensor 110. In FIG. 6, a reference numeral 600 denotes a charging roller of the charging unit 6.

Figure 7:
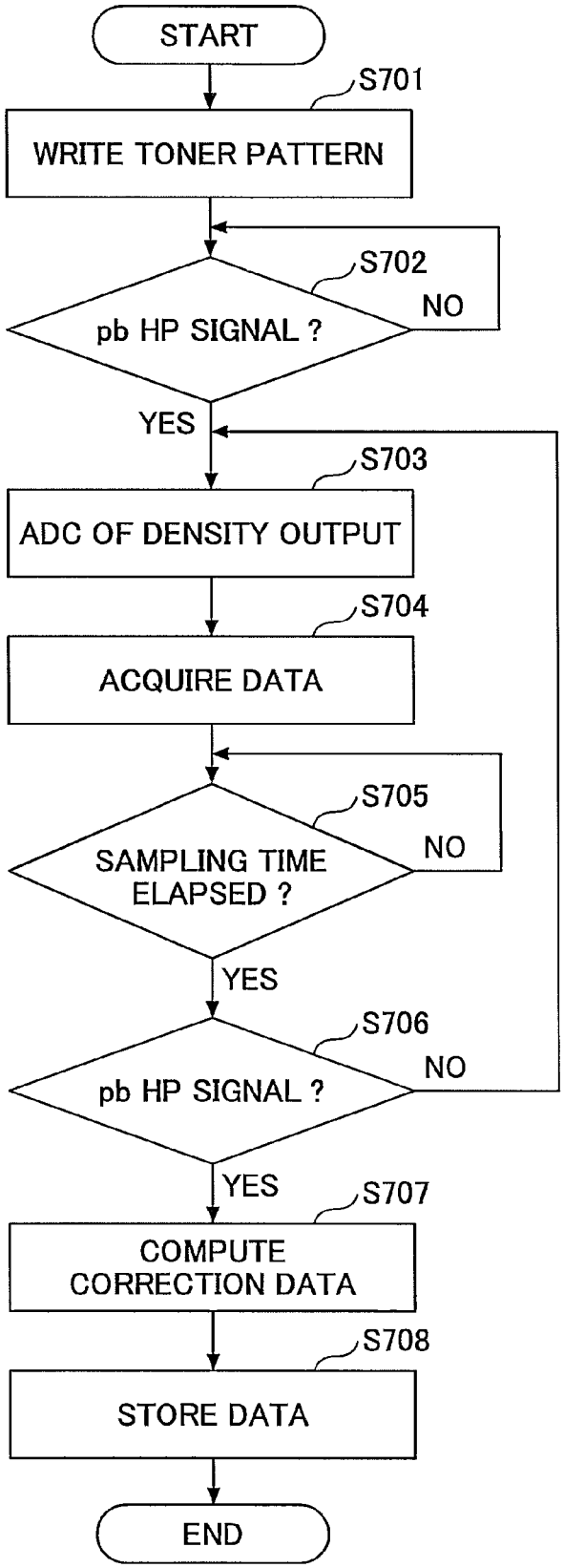
FIG. 7 is a flow chart for explaining an operation from density detection of a toner pattern to computation of correction data.

Next, a description will be given of an operation from density detection of the toner pattern to the computation of the correction data, by referring to FIG. 7. FIG. 7 is a flow chart for explaining the operation from the density detection of the toner pattern to the computation of the correction data. The process illustrated in FIG. 7 corresponds to the process of the steps S42 and S45 illustrated in FIG. 4. The toner pattern for the case corresponding to the step S42 illustrated in FIG. 4 is the 100% solid image band pattern (80% solid image band pattern for black), and the tone pattern for the case corresponding to the step S45 illustrated in FIG. 4 is the halftone band pattern.

When computing the correction data in the image forming apparatus 100 in this embodiment, the toner pattern of each of the colors is written on the intermediate transfer belt 5 (step S701). Then, the CPU 130 judges whether the pb HP signal of the photoconductive body 1 is detected (step S702). When the judgement result in the step S702 is YES, the CPU 130 controls the ADC 120 to sample the output of the toner density sensor 110 and to output a digital value (step S703), and acquires the density data of the toner pattern (step S704).

Next, the CPU 130 judges whether the sampling time of the density data has elapsed (step S705). When the judgement result in the step S705 is YES, the CPU 130 judges whether the pb HP signal of the photoconductive body 1 is detected again (step S706). When the judgement result in the step S706 is YES, the CPU 130 computes the correction data (step S707), and output the correction data to the storage unit 400 in order to store the correction data in the storage unit 400 (step S708).

Next, a description will be given of the computation of the correction data. In this embodiment, the correction data includes the correction data to correct the developing bias value and the correction data to correct the charging bias value. For example, the correction data may be computed and stored in the storage unit 400 at the time of forwarding the image forming apparatus 100 from a factory. In addition, the correction data may be computed at an arbitrary timing, such as when replacing parts of the image forming apparatus 100, for example.

For example, when a sinusoidal wave approximating the density non-uniformity is represented by $\alpha \sin(\omega t+\theta)$, and an amplitude value $\alpha$ and a phase lag value $\theta$ are to be obtained, the following formulas (3) may be obtained from the following formulas (1) and (2), where $\omega$ denotes an angular velocity of the photoconductive body 1, and * denotes a multiplication.

$$\begin{aligned} I &= \int_0^T \alpha * \sin(\omega t+\theta) * \sin(\omega t) dt \\ &= \alpha \int_0^T \{\sin(\omega t) * \cos(\theta) + \cos(\omega t) * \sin(\theta)\} * \sin(\omega t) dt \\ &= \alpha * \cos(\theta) \int_0^T \{\sin(\omega t)^2 dt + \alpha * \sin(\theta) \int_0^T \sin(\omega t) dt \\ &= \frac{\alpha}{2} * \cos(\theta) \end{aligned} \tag{1}$$

$$\begin{aligned} Q &= \int_0^T \alpha * \sin(\omega t+\theta) * \cos(\omega t) dt \\ &= \alpha \int_0^T \{\sin(\omega t) * \cos(\theta) + \cos(\omega t) * \sin(\theta)\} * \cos(\omega t) dt \\ &= \alpha * \cos(\theta) \int_0^T \{\sin(\omega t) * \cos(\omega t) dt + \\ &\quad \alpha * \sin(\theta) \int_0^T \cos(\omega t)^2 dt \\ &= \frac{\alpha}{2} * \sin(\theta) \end{aligned} \tag{2}$$

$$\begin{aligned} \alpha &= \sqrt{4(I^2+Q^2)} \\ \theta &= \operatorname{atan}(Q/I) \end{aligned} \tag{3}$$

Next, a description will be given of a method of computing a value I and a value Q in the formulas (3). For example, when it is assumed for the sake of convenience that a rotation period of the photoconductive body 1 is 100 ms, and the density data sampled for every 1 ms are denoted by $\beta_1, \beta_2, \ldots, \beta_{100}$, an average value $\gamma_{AVE}$ of the density data may be represented by the following formula (4).

$$\gamma_{AVE} = \frac{\beta_1 + \beta_2 + \ldots + \beta_{100}}{100} \tag{4}$$

When only a density non-uniformity component is extracted as density non-uniformity data, the density non-uniformity data may be represented by $(\beta_1-\gamma_{AVE})$, $(\beta_2-\gamma_{AVE}), \ldots, (\beta_{100}-\gamma_{AVE})$. When $\eta_n=(\beta_n-\gamma_{AVE})$, the value I and the value Q may be obtained from the following formulas (5) and (6).

$$I = \frac{\eta_1 \times \sin(2\pi \times 1/100) + \eta_2 \times \sin(2\pi \times 2/100) + \ldots + \eta_{100} \times \sin(2\pi \times 100/100)}{100} \tag{5}$$

$$Q = \frac{\eta_1 \times \cos(2\pi \times 1/100) + \eta_2 \times \cos(2\pi \times 2/100) + \ldots + \eta_{100} \times \cos(2\pi \times 100/100)}{100} \tag{6}$$

When the value I and the value Q computed from the formulas (5) and (6) are substituted into the formulas (3), the amplitude value of the density non-uniformity and the phase lag value from the rotary reference position may be obtained for the case in which the density non-uniformity is approximated by one period of the sinusoidal wave.

Next, when the density data and the developing bias that is a correction target are in a proportional relationship represented by a proportionality constant $\xi$, the developing bias to be corrected may be represented by the following formula (7), where $A_{xo}$ denotes amplitude correction data (or voltage) of the period of the photoconductive body 1, $\varnothing_{xo}$ denotes the phase data of the period of the photoconductive body 1, $\omega$ denotes the angular velocity of the photoconductive body 1 or the developing roller 20, tlay denotes the time (hereinafter also referred to as a "developing bias sensor arrival time") it takes for a virtual image to reach the toner density sensor 110 from the developing position or the charging position of the photoconductive body 1, and β denotes a value that is π for the developing bias and 0 for the charging bias.

$$Axo*\sin(\omega t+\phi xo)=\xi\times\{\alpha o*\sin(\omega(t+tlay)+\theta o+P+\beta)\} \quad (7)$$

The proportionality constant ξ, and the developing bias sensor arrival time tlay it takes for the virtual image to reach the toner density sensor 110 from the developing position or the charging position of the photoconductive body 1 differ between the charging bias and the developing bias.

When a charging bias proportionality constant is denoted by $\xi_{oc}$, a charging bias sensor arrival time it takes for the virtual image to reach the toner density sensor 110 from the charging position of the photoconductive body 1 is denoted by tlayc, a developing bias proportionality constant is denoted by $\xi_{ob}$, a developing bias sensor arrival time it takes for the virtual image to reach the toner density sensor 110 from the developing position of the photoconductive body 1 is denoted by tlayb, and an amplitude value of the density non-uniformity caused by the photoconductive body 1 is denoted by $\alpha_o$, the amplitude value included in correction data $A_{xoc}$ of the photoconductive body 1 for the charging bias may satisfy a relationship represented by $A_{xoc}=\xi_{oc}*\alpha_o$, and the phase lag value included in the correction data of the photoconductive body 1 for the charging bias may satisfy a relationship represented by $\varnothing_{xoc}=\theta_o+\omega*tlayc$, where ω denotes the angular velocity of the photoconductive body 1.

In addition, the amplitude value included in the correction data of the photoconductive body 1 for the developing bias may satisfy a relationship represented by $A_{xob}=\xi_{ob}*\alpha_o$, and the phase lag value included in the correction data of the photoconductive body 1 for the developing bias may satisfy a relationship represented by $\varnothing_{xob}=\theta_o+\pi+\omega*tlayc$, where ω denotes the angular velocity of the photoconductive body 1.

A period non-uniformity of the developing roller 20 may be computed in a manner similar to the period non-uniformity of the photoconductive body 1 because only the periods differ. When a charging bias proportionality constant is denoted by $\xi_{rc}$, the charging bias sensor arrival time is denoted by tlayc, a developing bias proportionality constant is denoted by $\xi_{rb}$, the developing bias sensor arrival time is denoted by tlayb, and an amplitude value of the density non-uniformity caused by the developing roller 20 is denoted by $\alpha_r$, the amplitude value included in the correction data of the developing roller 20 for the charging bias may satisfy a relationship represented by $A_{xrc}=\xi_{rc}*\alpha_r$, and the phase lag value included in the correction data of the developing roller 20 for the charging bias may satisfy a relationship represented by $\varnothing_{xrc}=\theta_r+\omega*tlayc$, where ω denotes the angular velocity of the developing roller 20.

In addition, the amplitude value included in the correction data of the developing roller 20 for the developing bias may satisfy a relationship represented by $A_{xrb}=\xi_{rb}*\alpha_r$, and the phase lag value included in the correction data of the developing roller 20 for the developing bias may satisfy a relationship represented by $\varnothing_{xrb}=\theta_r+\pi+\omega*tlayc$, where ω denotes the angular velocity of the developing roller 20. $\xi_{oc}$ may be equal to $\xi_{rc}$ ($\xi_{oc}=\xi_{rc}$) and $\xi_{ob}$ may be equal to $\xi_{rb}$ ($\xi_{ob}=\xi_{rb}$).

Next, a description will be given of the PWM generating units 200 and 300 in this embodiment, by referring to FIG. 8. The PWM generating unit 200 in this embodiment corrects the duty value of the PWM signal for generating the developing bias using the correction data for the developing bias. In addition, the PWM generating unit 300 in this embodiment corrects the duty value of the PWM signal for generating the charging bias using the correction data for the charging bias. In this embodiment, the PWM generating units 200 and 300 may have the same structure. Hence, FIG. 8 illustrates the PWM generating unit 200 as an example.

Figure 8:
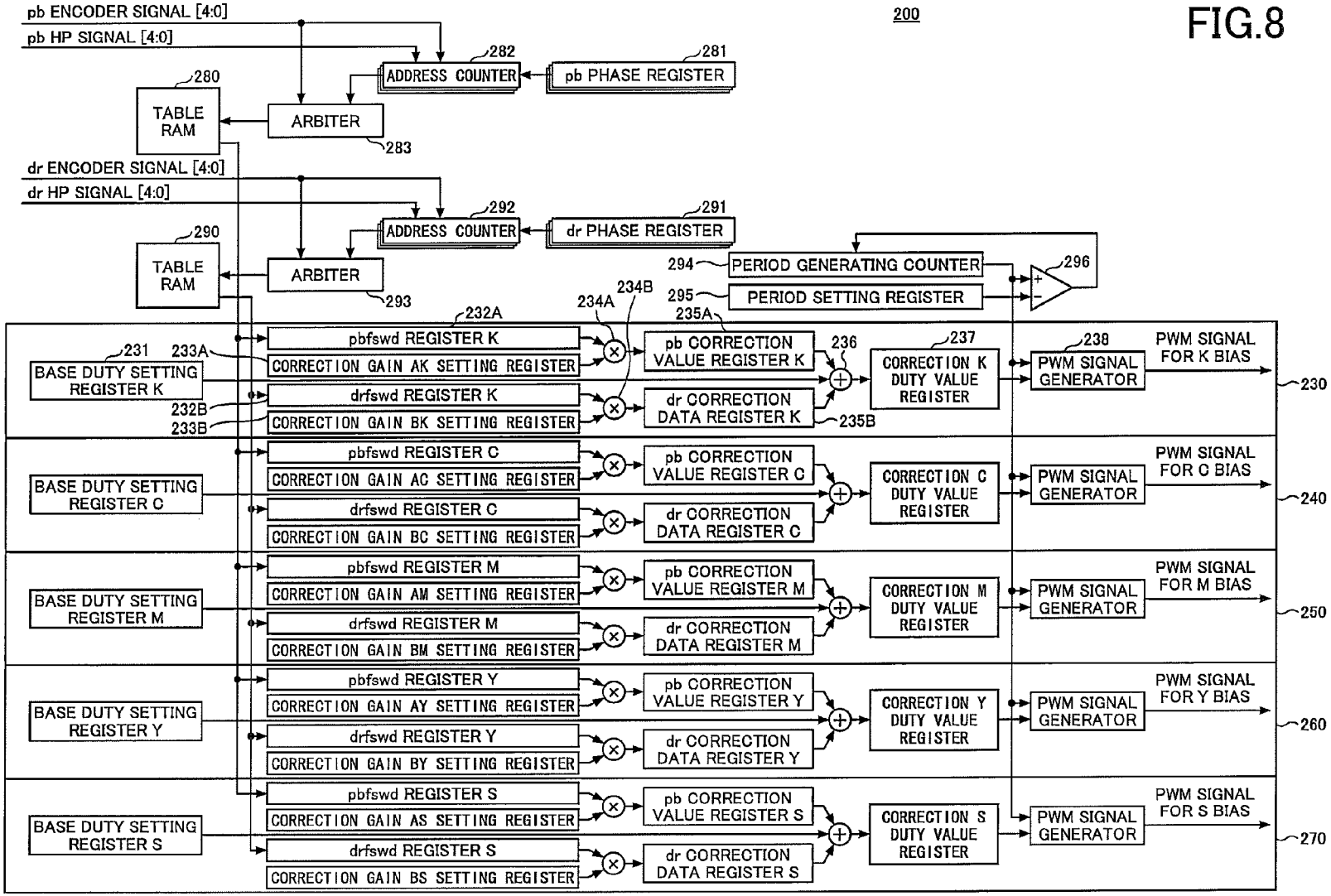
FIG. 8 is a diagram for explaining a PWM generating unit in the first embodiment.

FIG. 8 is a diagram for explaining the PWM generating unit in the first embodiment. The PWM generating unit 200 in this embodiment may include PWM generators 230, 240, 250, 260, and 270 provided in correspondence with the photoconductive bodies 1K, 1C, 1M, 1Y, and 1S, a photoconductive body period sinusoidal wave table RAM (Random Access Memory) 280, a photoconductive body (ph) phase register 281, an address counter 282, an arbiter 283, a developing roller period sinusoidal wave table RAM 290, a developing roller (dr) phase register 291, an address counter 292, an arbiter 293, a period generating register 294, a period setting register 295, and an amplifier 296.

The PWM generators 230, 240, 250, 260, and 270 may generate PWM signals for generating the charging bias to be applied to the corresponding photoconductive bodies 1. The PWM generators 230, 240, 250, 260, and 270 may have the same structure, and thus, a detailed description will be given of the PWM generator 230, as an example, later in the specification in conjunction with FIG. 10, for example.

The table RAM 280 may successively store sinusoidal wave data in an order with which the sinusoidal wave data are output. A storage location of the sinusoidal wave data may be selected by an address value. This address value may be managed by the address counter 282. The sinusoidal wave data may actually refer to duty values of a PWM signal that is used to represent the sinusoidal wave, and an amplitude value of this sinusoidal wave may be obtained from the corresponding duty value. In this example, a maximum amplitude value of the sinusoidal wave is equal to the amplitude value included in the correction data of the photoconductive body 1 for the developing bias. However, the maximum amplitude value of the sinusoidal wave may be greater than the amplitude value included in the correction data.

The phase lag value included in the correction data for the developing bias may be set to the pb phase register 281. In FIG. 8, only one pb phase register 281 is illustrated, however, the pb phase register 281 may be provided for each color, and may be set with the phase lag value included in the correction data of the photoconductive body 1 for the charging bias for each color.

The address counter 282 may read the value set to the pb phase register 281 every time the pb HP signal from the HP sensor 12 of the photoconductive body 1 is input thereto. The address counter 282 may count up at the timing of a rising edge of a photoconductive body encoder signal output from the rotary encoder 14, indicating a rotation period of the photoconductive body 1.

The address count (or address value) of the address counter 282 may be subjected to a bus arbitration in the arbiter 283, and then supplied to the table RAM 280. The bus arbitration is performed because the sinusoidal wave table 60 may be shared by the systems of the different colors and shared by 10 channels, for example. The table RAM 280 may output the sinusoidal wave data corresponding to the address to the PWM generators 230, 240, 250, 260, and 270.

Next, a description will be given of the table RAM 280. In this embodiment, the address value and the sinusoidal wave data are stored in correspondence with each other in a sinusoidal wave table within the table RAM 280.

Figure 9:
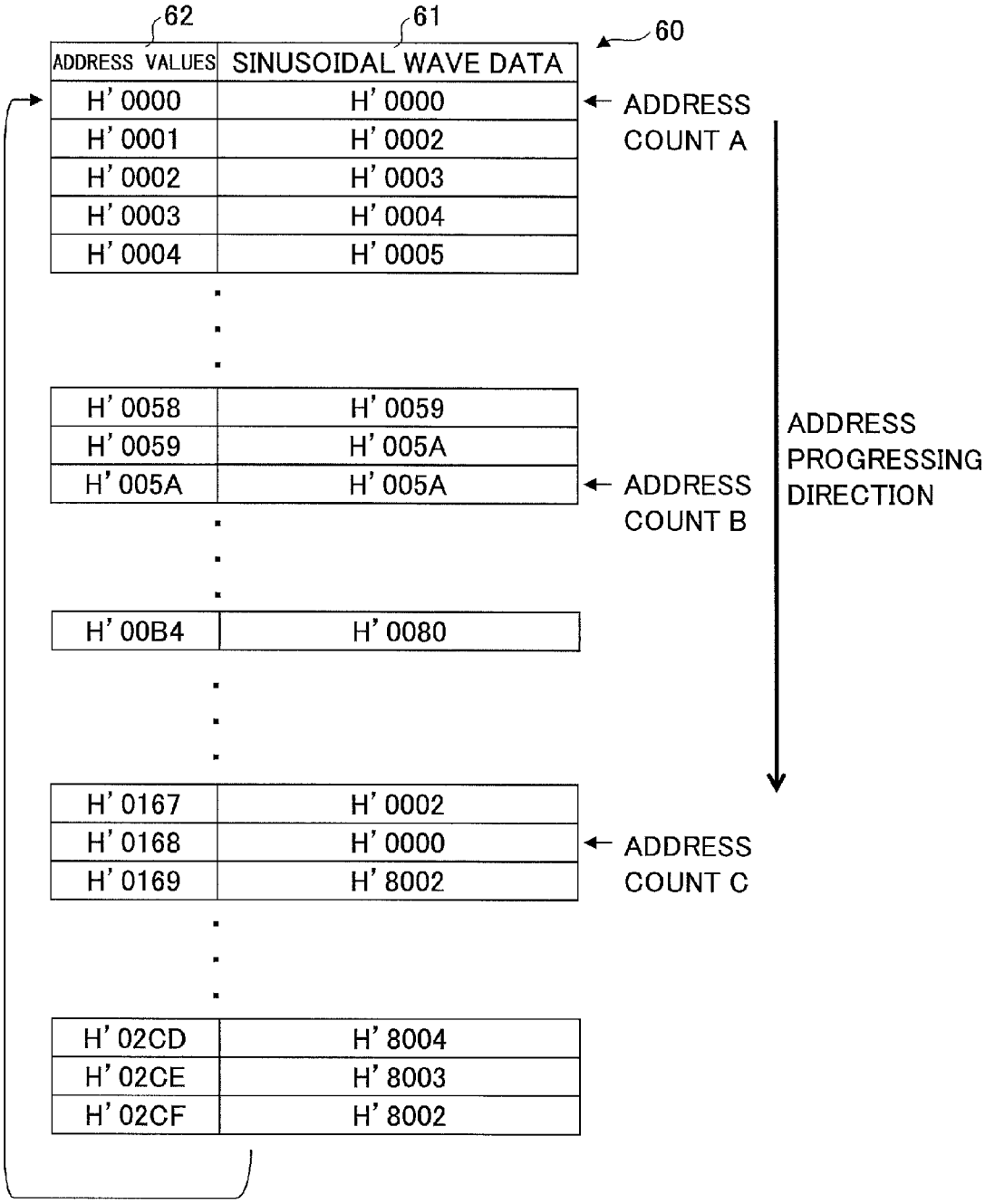
FIG. 9 is a diagram illustrating an example of a sinusoidal wave table.

FIG. 9 is a diagram illustrating an example of the sinusoidal wave table. In a sinusoidal wave table 60 illustrated in FIG. 9, sinusoidal wave data 61 and address values 62 are stored in correspondence with each other.

The address values 62 may be RAM addresses within the table RAM 280. Discrete data computed from $A_{max}$ sin(ωt) may be stored in the order of the addresses, as the sinusoidal wave data with respect to the address values 62, where $A_{max}$ denotes a maximum amplitude value of the correction data in one rotation period of the photoconductive body 1 or the developing roller 20, and ω denotes the angular velocity of the photoconductive body 1 or the developing roller 20. The number of sinusoidal wave data may depend on a time resolution of the discrete data approximating the sinusoidal wave data.

FIG. 9 illustrates an example in which the sinusoidal wave data, time-divided into 720 segments, are written from the address H'0000 to the address H'02CF. In this embodiment, negative data may be represented by data whose most significant bit is 1, in order to enable positive data and the negative data to be distinguished from each other. The address counter 282 may be preset by the set value of the pb phase register 281, in order to select the sinusoidal wave data. In FIG. 9, three phase addresses are set, and address counts A, B, and C indicate address values thereof. The address count returns to H'0000 when the last address (H'02CH in this example) is counted. When the pb HP signal is detected, the value in the pb phase register 281 is set to the value of the address counter 282 even at an intermediate point of the address count before the last address is counted.

In this embodiment, the sinusoidal wave table 60 may be shared by the PWM generators 230, 240, 250, 260, and 270.

The table RAM 290 may store sinusoidal wave data having a maximum amplitude value equal to the amplitude value (or correction quantity) of the correction data at the rotational period of the developing roller 20. The dr phase register 291 may be set with the phase lag value included in the correction data of the developing roller 20 for the charging bias. In FIG. 8, only one dr phase register 291 is illustrated, however, the dr phase register 291 may be provided for each color, and may be set with the phase lag value included in the correction data of the developing roller 20 for the charging bias for each color.

The address counter 292 may read the value set to the dr phase register 291 every time the dr HP signal from the HP sensor 21 of the developing roller 20 is input thereto. The address counter 292 may count up at the timing of a rising edge of a developing roller encoder signal output from the rotary encoder 23, indicating a rotation period of the developing roller 20.

The address count (or address value) of the counter 292 may be subjected to a bus arbitration in the arbiter 293, and then supplied to the table RAM 290. The table RAM 290 may output the sinusoidal wave data corresponding to the address to the PWM generators 230, 240, 250, 260, and 270. The table RAM 290 may be generated in a manner similar to the table RAM 280, in order to similarly store the sinusoidal wave data. Accordingly, a description of the table RAM 290 will be omitted.

In this embodiment, the sinusoidal wave table stored in the table RAM 280 may be the same as the sinusoidal wave table stored in the table RAM 290. The sinusoidal wave table stored in the table RAMs 280 and 290 may be determined according to the specifications of the photoconductive body 1, the specifications of the developing roller 20, and the like.

Figure 10:
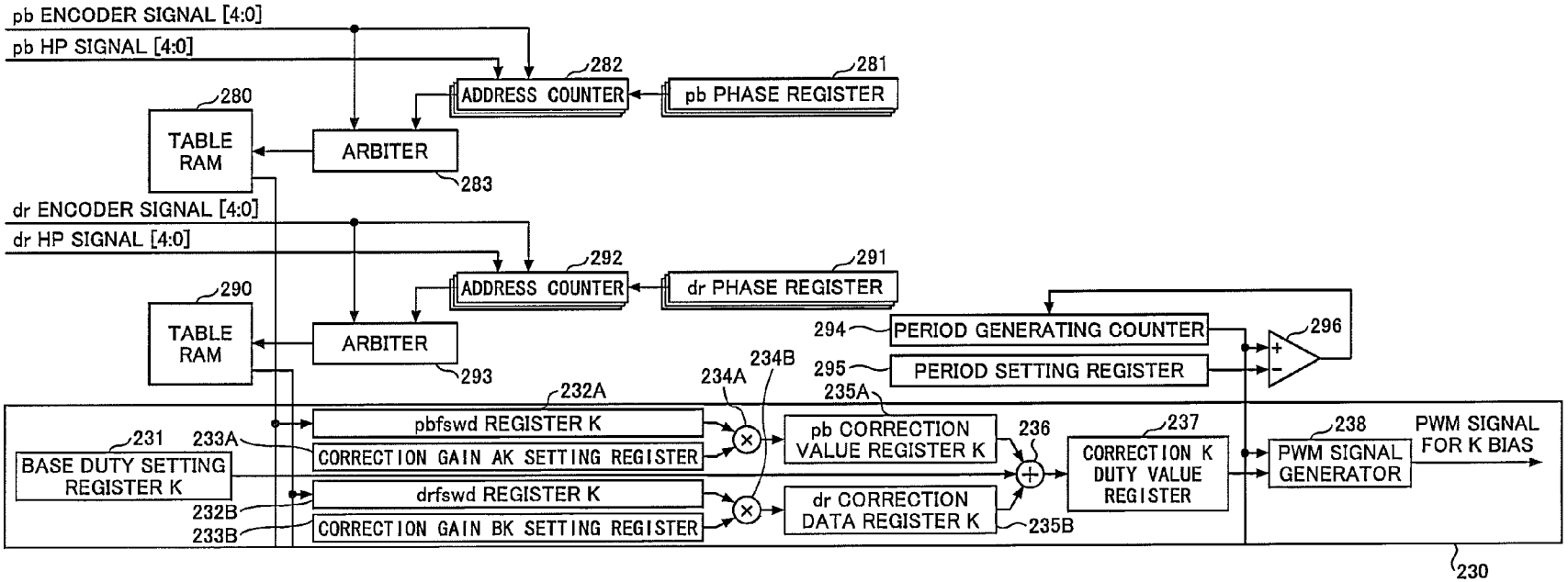
FIG. 10 is a diagram for explaining a PWM generator in the first embodiment.

Next, a detailed description will be given of the PWM generator 230, by referring to FIG. 10. FIG. 10 is a diagram for explaining the PWM generator in the first embodiment.

The PWM generator 230 in this embodiment may generate the PWM signal to be supplied to the high voltage supply 220 for the developing bias, via the integrator 210.

The PWM generator 230 may include a base duty setting register 231, a photoconductive body fundamental sinusoidal wave data (pbfswd) register 232A, a correction gain setting register 233A, a developing roller fundamental sinusoidal wave data (drfswd) register 232B, a correction gain setting register 233B, multipliers 234A and 234B, a photoconductive body (pb) correction value register 235A, a developing roller (dr) correction value register 235B, an adder 236, a correction duty value register 237, and a PWM signal generator 238.

A preset base (or reference) duty value may be set to the base duty setting register 230. The sinusoidal wave data in the table RAM 280 corresponding to the address value of the address counter 282 may be set to the pbfswd register 232A. The sinusoidal wave data in the table RAM 290 corresponding to the address value of the address counter 292 may be set to the drfswd register 232B.

A value based on the amplitude value included in the correction data of the photoconductive body 1 for the developing bias may be set to the correction gain setting register 233A. In this embodiment, this value may be obtained by multiplying 65536, for example, to a ratio of the amplitude value included in the correction data of the photoconductive body 1 and the amplitude value of the fundamental sinusoidal wave.

A value based on the amplitude value included in the correction data of the developing roller 20 for the developing bias may be set to the correction gain setting register 233B. In this embodiment, this value may be obtained by multiplying 65536, for example, to a ratio of the amplitude value included in the correction data of the developing roller 20 and the amplitude value of the fundamental sinusoidal wave. The value set to the correction gain setting registers 233A and 233B may be set from the CPU 130. The details of the values of correction gains set to the correction gain setting registers 233A and 233B will be described later in the specification.

The multiplier 234A may multiply the value set in the pbfswd register 232A and the value set in the correction gain setting register 233A. The multiplier 234B may multiply the value set in the drfswd register 232B and the value set in the correction gain setting register 233B.

An output vale of the multiplier 234A may be set to the pb correction value register 235A. An output value of the multiplier 234B may be set to the dr correction value register 235B.

The adder 236 may add the value set in the pb correction value register 235A, the value set in the dr correction value register 235B, and the value set in the base duty setting register 231. In a case in which the value set in these registers has a negative value, the adder 236 may substantially carry out a subtraction.

An output value of the adder 236 may be set to the correction duty value register 237. The value set to in the correction duty value register 237 may be the duty value of the corrected PWM signal.

The PWM signal generator 238 may generate the PWM signal based on the signal output from the period generating counter 294 and the duty value set in the correction duty value register 237, and output the generated PWM signal.

Next, a description will be given of the operation of the PWM generator 230 in this embodiment.

In the image forming apparatus 100, the rotary encoder 14 provided on the axis of the photoconductive body 1K may output a pulse depending on a rotary angle of the photoconductive body 1K. In addition, the rotary encoder 23 provided on the axis of the developing roller 20K may output a pulse depending on a rotary angle of the developing roller 20K. In the following description, the pulse output from the rotary encoder 14 may also be referred to as the photoconductive body (pb) encoder signal, and the pulse output from the rotary encoder 23 may also be referred to as the developing roller (dr) encoder signal.

In this embodiment, when the pb encoder signal is output, the address counter 282 counts up, and the sinusoidal wave data may be selected from the table RAM 280. The selected sinusoidal wave data may be set to the pbfswd register 232A.

Further, in this embodiment, the pb encoder signal may include 720 pulses per one revolution of the photoconductive body 1K, for example. Hence, the sinusoidal wave data may be divided into 720 segments, and the segment data may be stored in the table RAM 280. Alternatively, the sinusoidal wave data may be divided into 80 segments, for example, and the address may be counted up by one (1) for every four (4) pulses of the pb encoder signal.

When the dr encoder signal is output, the address counter 292 counts up, and the sinusoidal wave data may be selected from the table RAM 290. The selected sinusoidal wave data may be set to the drfswd register 232B.

Next, a description will be given of the flow of the data, the signals, and the values set in each of the registers.

In the PWM generator 230 in this embodiment, the PWM signal may be generated using the phase lag value and the amplitude value included in the correction data of the photoconductive body 1K for the developing bias, and the phase lag value included in the correction data of the developing roller 20K for the developing bias.

A description will be given of the operation of the PWM generator 230.

In this embodiment, each data width may be 16 bits, and the operation frequency of the period generating counter 294 may be 40 MHz. Further, in this embodiment, the frequency of the PWM signal may be 20 kHz, the bias resolution of the PWM signal may be 1000 V when the duty is 100%, and the duty of the PWM signal may change linearly from 0%. Moreover, in this embodiment, the charging bias that becomes the reference may be 600 V, the sinusoidal wave data of the period of the photoconductive body 1K may be divided into 720 segments, and the sinusoidal wave data of the period of the developing roller 20K may be divided into 180 segments. The maximum amplitude value $A_{omax}$ of the rotation period of the photoconductive body 1K in the table RAM 280 and the maximum amplitude value $A_{rmax}$ of the rotation period of the developing roller 20K in the table RAM 290 may be set to $A_{omax}=A_{rmax}=64$V, and may be converted into the duty value of H'0080 (hexadecimal).

The value obtained from the following formula may be set to the period setting register 295 in this embodiment.

$$[\text{Period Setting Register Value}] = (40\ \text{MHz})/(20\ \text{kHz}) = H'07D0(\text{hexadecimal})$$

In addition, the value obtained from the following formula may be set to the base duty setting register 231 in this embodiment.

$$[\text{Base Duty Setting Register Value}]=2000*(600\ \text{V})/(1000\text{V})H'04B0\ (\text{hexadecimal})$$

The value obtained from the following formula may be set to the pb phase register 281 in this embodiment, where $ø_{co}$ denotes the phase lag value (or charging bias) included in the correction data of the photoconductive body 1K. The pb phase register 281 in this embodiment has 16 bits.

$$[\text{Photoconductive Body Phase Register Value}]=ø_{co}*720/360$$

The address counter 282 may load the value set in the pb phase register 281, every time the pb HP signal from the HP sensor 12 is input, and carryout a count-up operation at a timing synchronized to the rising edge of the pb encoder signal. The address value of the sinusoidal wave data selected by the address counter 282 may be supplied to the arbiter 283 that carries out the bus arbitration. In this embodiment, the sinusoidal wave table 60 may be shared by 10 channels, and thus, the simultaneous access to the table RAM 280 from the address counters 282 of each of the colors may be prevented by the provision of the arbiter 283.

The selected sinusoidal wave data may be set to the pbfswd register 232A. The sinusoidal wave data may be multiplied to the value set in the correction gain setting register 233A, in the multiplier 234A.

In this embodiment, the value set in the correction gain setting register 233A is such that a 16-bit data may be obtained as a multiplication result from the multiplier 234A. The value set in the correction gain setting register 233A may be obtained from the following formula, where $A_{co}$ may denote the value that is obtained by multiplying 65536 to the ratio of the amplitude value included in the correction data of the photoconductive body 1K for the developing bias and the amplitude value of the fundamental sinusoidal wave, and $A_{omax}$ may denote the maximum amplitude value of the correction data in one rotation period of the photoconductive body 1K.

$$[\text{Correction Gain Setting Register Value}]=65536*A_{co}/A_{omax}$$

In this embodiment, the value of the correction gain setting register 233A is set in the manner described above, so that the 16-bit data is obtained as the multiplication result from the multiplier 234A.

In this embodiment, the data with of each of the pbfswd register 232A and the correction gain setting register 233A is 16 bits. Hence, when the values set in these registers 232A and 233A are multiplied, a 32-bit data may be obtained.

In this embodiment, the value described above is set to the correction gain setting register 233A, in order to realize a function of extracting upper 16 bits of the 32-bit data. By subjecting the 32-bit data that is obtained as the multiplication result to a 15-bit shift, a function of dividing the 32-bit data by 65536 may be realized, and the value set in the pb correction value register 235A may be formed as the 16-bit value to be set with respect to the pbfswd register 232A. In this embodiment, the data width is 16 bits, however, the data width is not limited to 16 bits. For example, the data width may be determined according to the storage capacity of the table RAM 280.

In the PWM generator 230 in this embodiment, a setting similar to the setting with respect to the period of the photoconductive body 1 may be made with respect to the period of the developing roller 20K. A value obtained from the following formula may be set to the dr phase register 291.

$$[\text{Developing Roller Phase Register Value}]=ø_{cr}*180/360$$

In addition, a value obtained from the following formula may be set to the correction gain setting register 233B, where $A_{cr}$ may denote the value that is obtained by multiplying 65536 to the ratio of the amplitude value included in the correction data of the developing roller 20K for the developing bias and the amplitude value of the fundamental sinusoidal wave, and $A_{rmax}$ may denote the maximum amplitude value of the correction data in one rotation period of the developing roller 20K.

$$[\text{Correction Gain Setting Register Value}]=65536*A_{cr}/A_{rmax}$$

The multiplication results of the multipliers 234A and 234B may be set to the pb correction value register 235A and the developing roller correction value register 235B, respectively. A maximum value $D_{bomax}$ of the value set in the pb correction value register 235A and a maximum value $D_{crmax}$ of the value set in the dr correction value register 235B may be represented by the following formulas.

$$D_{bomax}=[\text{Correction Gain Setting Register Value (Photoconductive Body Side)}]*A_{omax}$$

$$D_{brmax}=[\text{Correction Gain Setting Register Value (Developing Roller Side)}]*A_{rmax}$$

The duty value of the PWM signal generated by the PWM signal generator 238 may be represented by the following formula. The PWM signal generator 238 generates the PWM signal for generating the developing bias, where $D_{bb}$ denotes a value set in the base duty setting register 231, $D_{bo}$ denotes a value set in the pb correction value register 235A, and $D_{br}$ denotes a value set in the dr correction value register 235B.

$$[\text{Duty Value of PWM Signal}]=D_{bb}+D_{bo}*\sin(\omega_{ot}-\varnothing_{bo})+D_{br}*\sin(\omega_{rt}-\varnothing_{br})$$

In this embodiment, by setting the values to each of the registers in the manner described above, the duty value of the PWM signal may be varied according to a detection timing of the pb encoder signal and the detection timing of the dr encoder signal, in order to superimpose (or add) the correction values on the reference developing bias. Similarly, the correction values may be superimposed on (or added to) the reference charging bias.

In this embodiment, the PWM generators 240, 250, 260, and 270 of the PWM generating unit 200 may have a structure similar to that of the PWM generator 230. Hence, according to this embodiment, the generation of the density non-uniformity may be suppressed by correcting the developing bias for every photoconductive body 1 of each of the colors.

In addition, in this embodiment, the PWM generating unit 300 may have a structure similar to that of the PWM generating unit 200. Hence, according to this embodiment, the generation of the density non-uniformity may be suppressed by correcting the charging bias for every photoconductive body 1 of each of the colors. The PWM generating unit 200 for generating the developing bias and the PWM generating unit 300 for generating the charging bias are provided separately in this embodiment. However, when the values set to each of the registers are the same for the PWM generating unit 200 and the PWM generating unit 300, for example, the developing bias and the charging bias may be generated from a single PWM generating unit.

Figure 11:
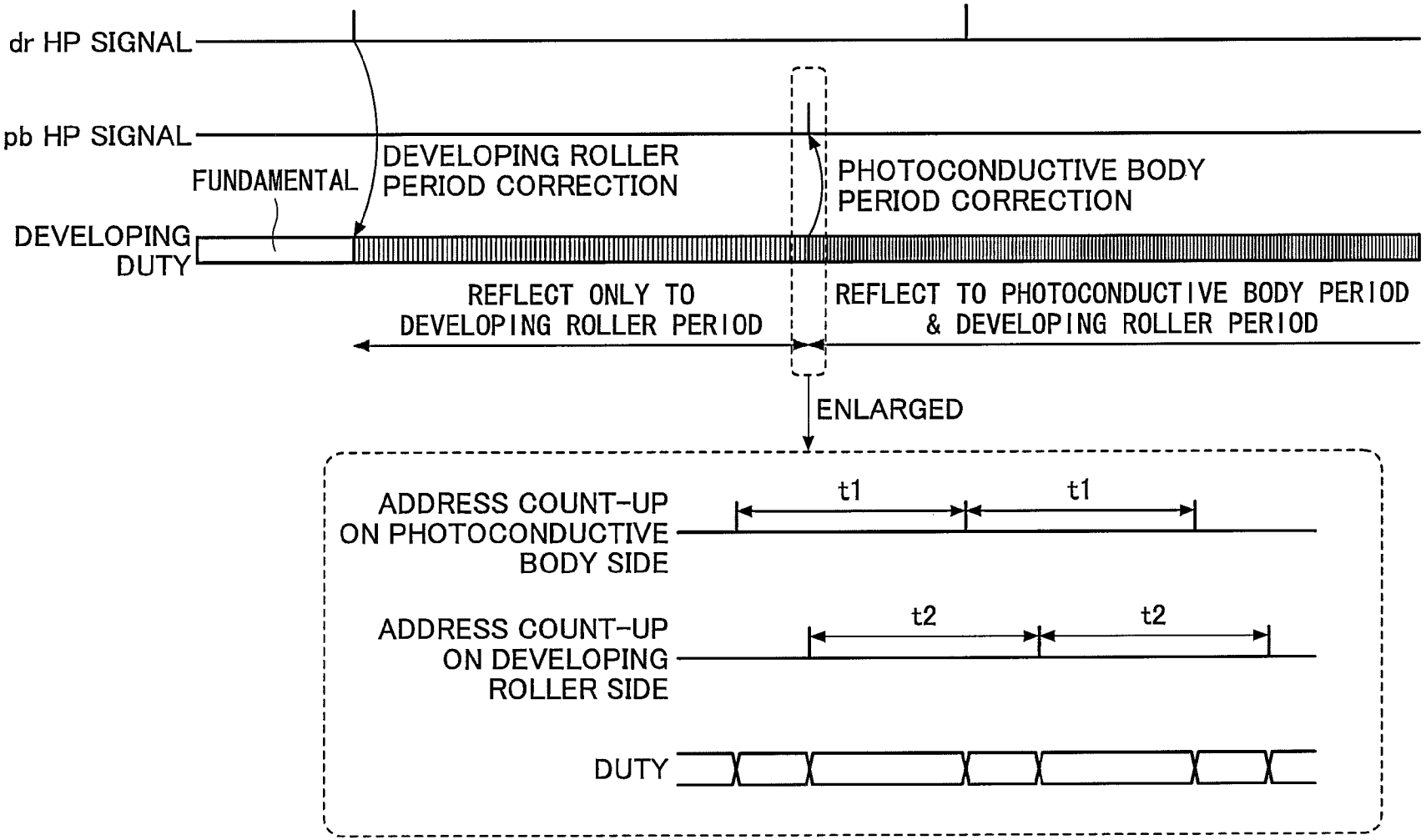
FIG. 11 is a diagram illustrating an output timing of a PWM signal to correct a periodic fluctuation of a photoconductive body and a periodic fluctuation of a developing roller at a developing bias in the first embodiment.

FIG. 11 is a diagram illustrating an output timing of the PWM signal to correct a periodic fluctuation of the photoconductive body and a periodic fluctuation of the developing roller at the developing bias in the first embodiment.

At the start of outputting the PWM signal from the PWM generating unit 200 of the image forming apparatus 100 in this embodiment, the PWM signal may have the base duty value set in the base duty setting register 231. Thereafter, when the dr HP signal output from the HP sensor 21 of the developing roller 20 is detected, the PWM generating unit 200 may start selecting the duty values from the table RAM 290 and output the PWM signal in which the corrected duty values are superimposed on the base duty value. The duty value selected from the table RAM 290 may change every time the address count of the address counter 292 is counted up, to thereby change the duty value of the PWM signal.

Thereafter, when the pb HP signal output from the HP sensor 12 of the photoconductive body 1 is detected, the PWM generating unit 200 may start selecting the duty values from the table RAM 280 and output the PWM signal in which the corrected duty values are superimposed on the base duty value. The duty value selected from the table RAM 280 may change every time the address count of the address counter 282 is counted up, to thereby change the duty value of the PWM signal.

In this embodiment, the dr encoder signal output from the rotary encoder 23 is used as a switching signal to switch the duty value of the PWM signal. However, in a case in which a brushless motor is used to drive the photoconductive body 1 or the developing roller 20, for example, a FG signal or a Hall signal indicative of a rotor position of the brushless motor may be used as the switching signal to switch the duty value of the PWM signal. In addition, in the case of the brushless motor employing a PLL (Phase Locked Loop) control, a reference clock of the PLL may be used as the switching signal. Further, in the case of a stepping motor, a clock signal that determines the rotational speed of the stepping motor may be used as the switching signal.

Figure 12A:
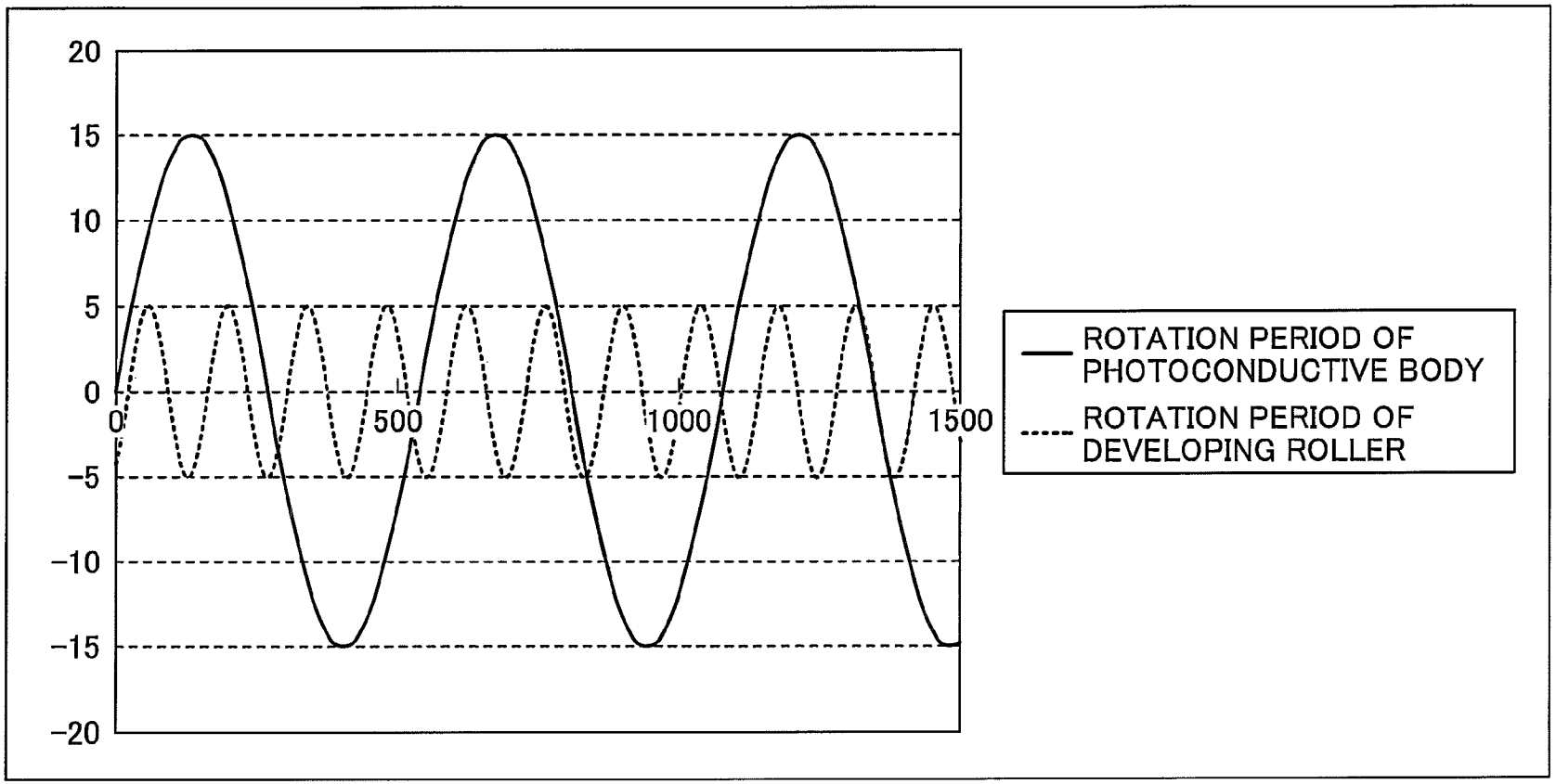
FIGS. 12A and 12B are diagrams illustrating examples of corrected charging bias or corrected developing bias in the first embodiment.
Figure 12B:
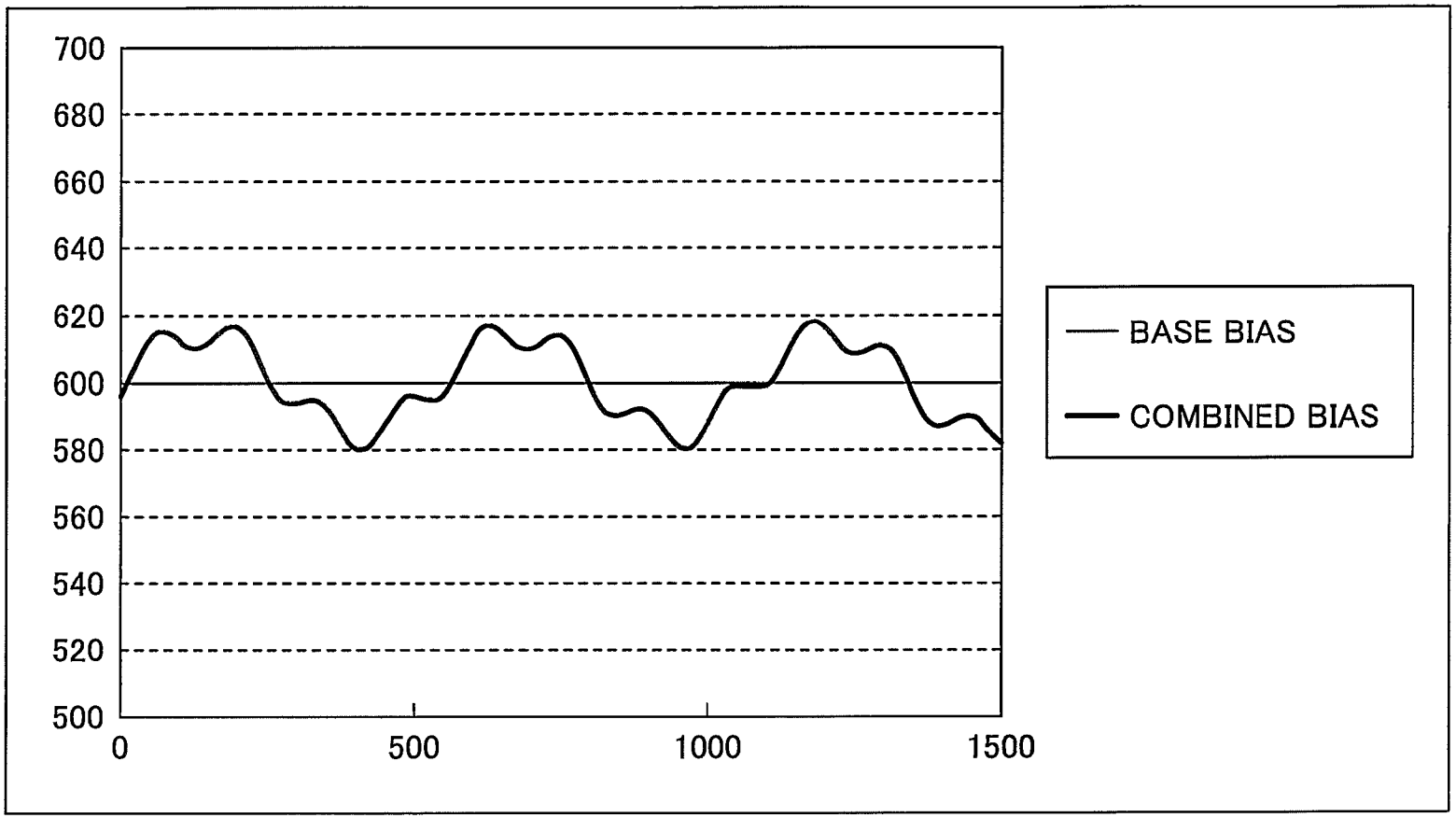

FIGS. 12A and 12B are diagrams illustrating examples of corrected charging bias or corrected developing bias in the first embodiment. FIG. 12A illustrates examples of the rotation period of the photoconductive body 1 and the rotation period of the developing roller 20. FIG. 12B illustrates examples of the charging bias after the correction or the developing bias after the correction.

FIGS. 12A and 12B illustrate a case in which the corrected duty value of the rotation period of the photoconductive body 1, 15 $\sin(\omega_1 t)$ [V], and the corrected duty value of the rotation period of the developing roller 20, 5 $\sin(\omega_2 t-\varnothing)$, are superimposed with respect to the base bias of 600 [V], where the angular velocities $\omega_1$ and $\omega_2$ of the photoconductive body 1 and the developing roller 20, respectively, satisfy a relationship $\omega_1<\omega_2$.

As described above, the PWM generating units 200 and 300 in this embodiment correct the base duty value of the PWM signal based on the correction data for correcting the rotation period of the photoconductive body 1 and the correction data for correcting the rotation period of the developing roller 20. In this embodiment, this correction may be realized by a hardware circuit that corrects the density non-uniformity caused by the developing gap, and thus, the processing load on the CPU may be reduced.

Second Embodiment

Figure 13:
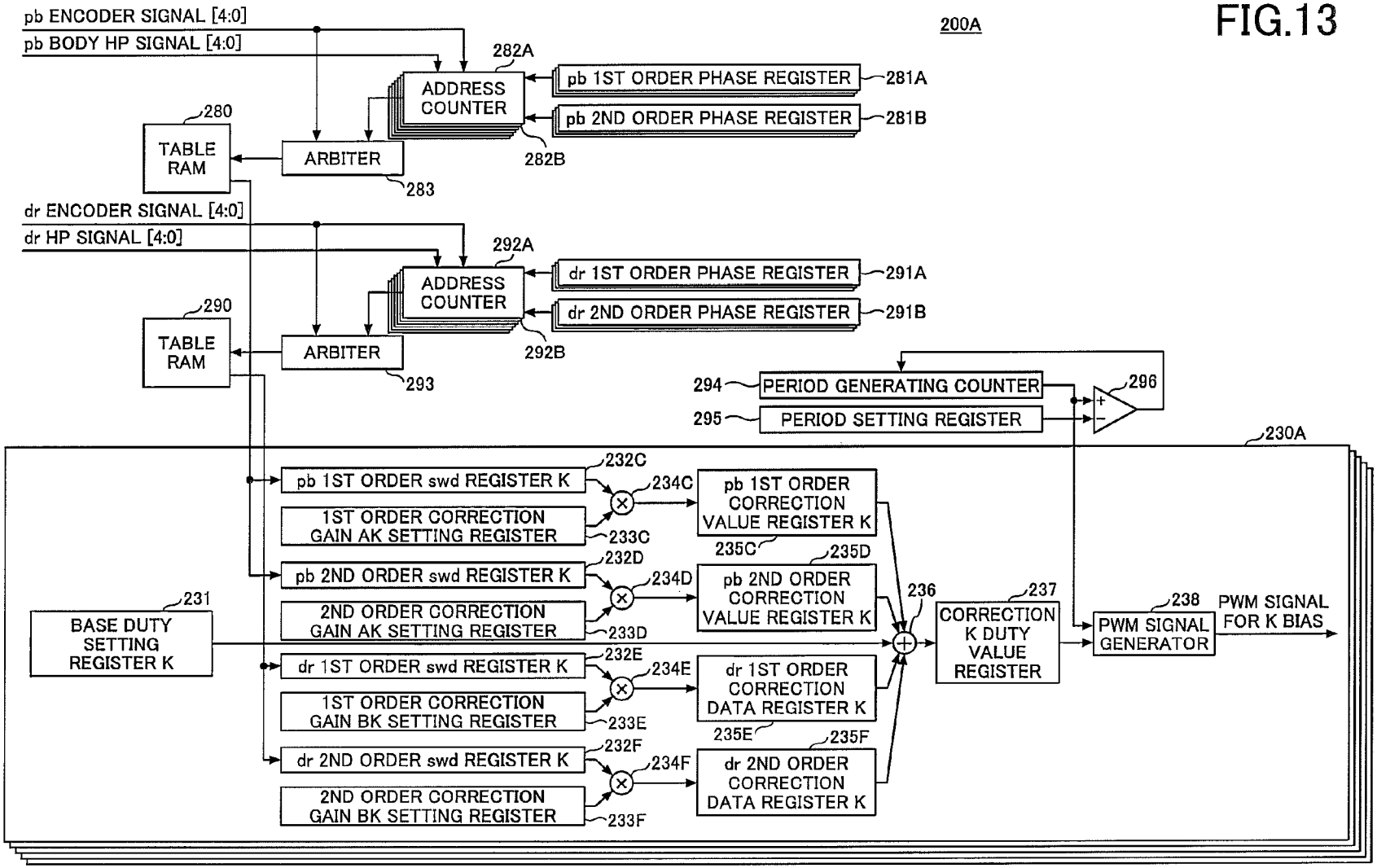
FIG. 13 is a diagram for explaining the PWM generator in a second embodiment.

Next, a description will be given of a second embodiment of the present invention, by referring to FIG. 13. FIG. 13 is a diagram for explaining the PWM generator in the second embodiment.

This second embodiment differs from the first embodiment in that the rotation period of the photoconductive body 1, the rotation period of the developing roller 20, the correction data for correcting the rotation period of the photoconductive body 1, and the correction data for correcting the rotation period of the developing roller 20 are approximated by first order components and second order components of the sinusoidal wave. Otherwise, this second embodiment is similar to the first embodiment. In FIG. 13, those parts that have the same function as the corresponding parts of the first embodiment illustrated in FIG. 10 are designated by the same reference numerals, and a description thereof will be omitted.

A PWM generating unit 200A illustrated in FIG. 13 may output a PWM signal for generating the developing bias in the image forming apparatus 100. The PWM generating unit 200A may include PWM generators corresponding to the photoconductive body 1 and the developing roller 20 for each of the colors. FIG. 13 illustrates only one PWM generating unit 230A, as an example.

In this embodiment, the PWM generating unit 200A may include a pb first order phase register 281A for the photoconductive body 1, storing phase values included in the correction data of a first order component, and a pb second order phase register 281B for the photoconductive body 1, storing phase values included in the correction data of a second order component.

In addition, in this embodiment, an address counter 282A for the first order component, and an address counter 282B for the second order component sinusoidal wave may be provided. The address counter 282A may count up by one (1) for each count, while the address counter 282B may count up by two (2) for each count. In this embodiment, a start address of the pb first order phase register 281A and a start address of the pb second order phase register 281B may be selected by taking a frequency response into consideration.

In this embodiment, the PWM generating unit 200A may further include a dr first order phase register 291A for the developing roller 20, storing phase values included in the correction data of the first order component, and a dr second order phase register 291B for the developing roller 20, storing phase values included in the correction data of the second order component. In addition, an address counter 292A for the first order component, and an address counter 292B for the second order component sinusoidal wave may be provided. The address counter 292A may count up by one (1) for each count, the address counter 292B may count up by two (2) for each count. In this embodiment, a start address of the dr first order phase register 289A and a start address of the dr second order phase register 291B may be selected by taking a frequency response into consideration.

In this embodiment, the registers are provided separately for the first order component and the second order component. However, a single register may be used in common for the first order component and the second order component.

The address value (or storage location) of the sinusoidal wave data may be selected by the address counter 282A and set to a pb first order sinusoidal wave data (swd) register 232C. A value determined in a manner similar to that of the first embodiment, based on the amplitude value included in the correction data of the first order component, may be set to a first order correction gain setting register 233C. The values set in the pb first order swd register 232C and the first order correction gain setting register 233C may be multiplied in a multiplier 234C, and a multiplication result from the multiplier 234C may be set to a pb first order correction value register 235C.

The address value (or storage location) of the sinusoidal wave data may be selected by the address counter 282B and set to a pb second order sinusoidal wave data (swd) register 232D. A value determined in a manner similar to that of the first embodiment, based on the amplitude value included in the correction data of the second order component, may be set to a second order correction gain setting register 233D. The values set in the pb second order swd register 232D and the second order correction gain setting register 233D may be multiplied in a multiplier 234D, and a multiplication result from the multiplier 234D may be set to a pb first order correction value register 235D.

The address value (or storage location) of the sinusoidal wave data may be selected by the address counter 292A and set to a dr first order sinusoidal wave data (swd) register 232E. A value determined in a manner similar to that of the first embodiment, based on the amplitude value included in the correction data of the first order component, may be set to a first order correction gain setting register 233E. The values set in the dr first order swd register 232E and the first order correction gain setting register 233E may be multiplied in a multiplier 234E, and a multiplication result from the multiplier 234E may be set to a dr first order correction value register 235E.

The address value (or storage location) of the sinusoidal wave data may be selected by the address counter 292B and set to a dr second order sinusoidal wave data (swd) register 232F. A value determined in a manner similar to that of the first embodiment, based on the amplitude value included in the correction data of the second order component, may be set to a second order correction gain setting register 233F. The values set in the dr second order swd register 232F and the second order correction gain setting register 233F may be multiplied in a multiplier 234F, and a multiplication result from the multiplier 234F may be set to a dr first order correction value register 235F.

The values set in the pb first order correction value register 235C, the pb second order correction value register 235D, the dr first order correction value register 235E, and the dr second order correction value register 235F, and the value set in the base duty setting register 231 may be added in the adder 236. An added value from the adder 236 may be set to the correction duty value register 237.

The duty value set to the correction duty value register 237 may be represented by the following formula. As may be seen from the following formula, the duty value set to the correction duty value register 237 is a combined value of the first order component and the second order component, where $D_{bb}$ denotes the value set in the base duty setting register 231, $D_{bo1}$ denotes the value set in the pb first order correction value register 235C, $D_{bo2}$ denotes the value set in the pb second order correction value register 235D, $D_{br1}$ denotes the value set in the dr first order correction value register 235E, and $D_{br2}$ denotes the value set in the dr second order correction value register 235F.

$$[\text{Duty Value}]=D_{bb}+D_{bo1}*\sin(\omega_o t-\varnothing_{bo1})+D_{bo2}*\sin(\omega_o t-\varnothing_{bo2})+D_{br1}+\sin(2\omega_r t-\varnothing_{br1})+D_{br2}*\sin(2\omega_o t-\varnothing_{br2})$$

The PWM signal generator 238 may generate the PWM signal based on the signal output from the period generating counter 294 and the duty value set in the correction duty value register 237, and output the generated PWM signal.

In this embodiment, the table RAM 280 and the table RAM 290 may be shared and used in common for the first order component and the second order component of the sinusoidal wave data. However, the first order component and the second order component of the sinusoidal wave data may be stored in separate table RAMS, with respect to the photoconductive body 1 and the developing roller 20. In addition, although this embodiment adds the first order component and the second order component, components of the third and subsequent orders may also be added. When using the third order component, an address counter and a correction gain setting register may further be provided for the third order component, and this address counter may count up by three (3) for each count. A similar modification may be made when using a fourth order component and components of a fifth and subsequent orders. In this case, the added duty value may be represented by the following formula (8).

$$Dcb + \sum_{n=1}^{k} Dcon * \mathrm{Sin}(n\omega o * t - \phi con) + \sum_{n=1}^{k} Dcrn * \mathrm{Sin}(n\omega r * t - \phi crn) \quad (8)$$

Therefore, according to this embodiment, the correction of the density non-uniformity caused by the developing gap may be realized by a hardware circuit, and thus, the processing load on the CPU may be reduced, similarly as in the case of the first embodiment.

Third Embodiment

Figure 14:
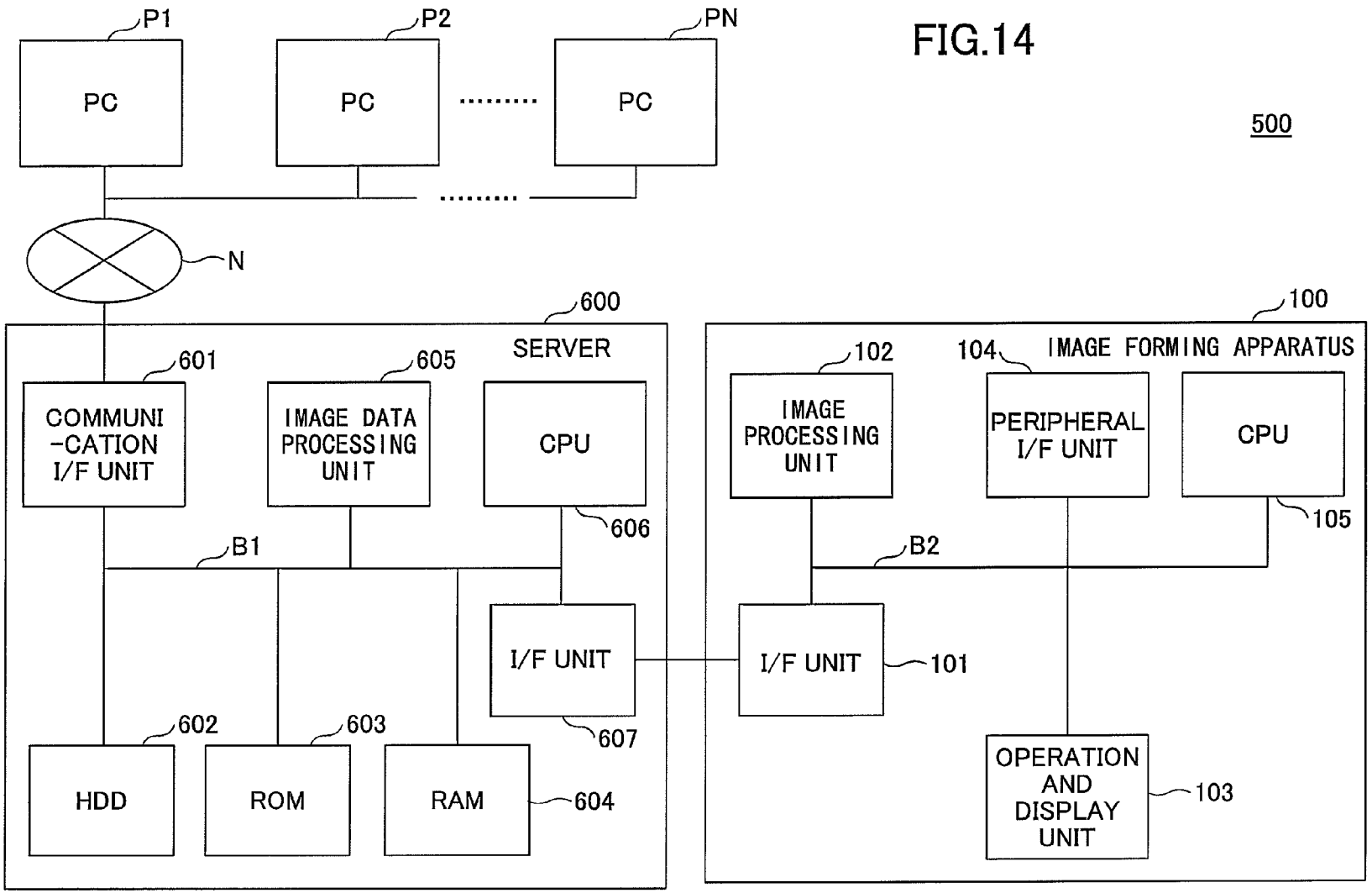
FIG. 14 is a diagram illustrating an example of a system structure of an image forming system in a third embodiment.

Next, a description will be given of a third embodiment of the present invention, by referring to FIG. 14. FIG. 14 is a diagram illustrating an example of a system structure of the image forming system in the third embodiment. In FIG. 14, those parts that have the same function as the corresponding parts of the first embodiment are designated by the same reference numerals, and a description thereof will be omitted. In this embodiment, the present invention is applied to an image forming system that stores the correction data in an external apparatus.

In this embodiment, an image forming system 500 may include the image forming apparatus 100 and a server 600 that are connected via suitable interface units. The server 600 may be connected to PCs (Personal Computers) P1, P2, . . . , and PN via a network N.

In this embodiment, the correction data computed by a CPU 130 of the image forming apparatus 100 may be stored in the server 600. The server 600 may include a communication interface (I/F) unit 601 connected to the network N, a HDD (Hard Disk Drive) 602, a ROM (Read Only Memory) 603, a RAM 604, an image processing unit 605 to adjust an output image, a CPU 606, and an interface (I/F) unit 607 that are connected via a bus B1. The I/F unit 607 may communicably connect to the image forming apparatus 100 via a dedicated line or the like.

In this embodiment, the image forming apparatus 100 may include an interface (I/F) unit 101, an image processing unit 102, an operation and display unit 103, a peripheral interface (I/F) unit 104, and a CPU 105 that are connected via a bus B2. The I/F unit 101 may communicably connected to the server 600 via the dedicated line or the like. The operation and display unit 103 may include a display to display information, such as menus and messages, to the user, and an input device, such as a keys, to be manipulated by the user to input information, such as commands, to the image forming apparatus 100. The image forming apparatus 100 may execute a print job under the control of the CPU 606 of the server 600.

For example, the image processing unit 102 of the image forming apparatus 100 may include the CPU 130, the PWM generating units 200 and 300, and the like. The image processing unit 102 may output the correction data computed by the CPU 130 to the server 600 via the I/F unit 101. The server 600 may store the correction data received via the I/F unit 607 into a storage unit, such as the HDD 602. The server 600 may supply the correction data stored in the storage unit thereof to the image forming apparatus 100 every time the image forming apparatus 100 executes the print job. The image forming apparatus 100 may set the correction data received via the I/F unit 101 to the respective registers before executing an image forming operation of the print job. Of course, the correction data may be prestored within the server 600.

According to the disclosed PWM generating unit, image forming apparatus, image forming method, and image forming system, the density non-uniformity may be corrected with a reduced processing load. More particularly, the density non-uniformity may be corrected by a hardware circuit, in order to reduce the processing load on the CPU.

Further, the present invention is not limited to these embodiments, but various variations and modifications may be made without departing from the scope of the present invention.

What is claimed is:

1. A PWM generating unit to generate a PWM signal, comprising:

a base duty setting register configured to store a base duty value that is set thereto; and a PWM generator configured to obtain a corrected duty value by correcting the base duty value based on first correction data and second correction data, and to generate the PWM signal according to the corrected duty value, wherein the first correction data is computed from a rotation period of a first rotational body that forms an electrostatic latent image, and the second correction data is computed from a rotation period of a second rotational body that develops the electrostatic latent image on the first rotational body, and wherein the PWM signal determines at least one of a charging bias voltage to charge the first rotational body and a developing bias voltage to be applied to the second rotational body.

2. The PWM generating unit as claimed in claim 1, further comprising:

a first storage unit configured to store duty values to be used to correct the base duty value, in correspondence with addresses of the first storage unit; and a second storage unit configured to store duty values to be used to correct the base duty value, in correspondence with addresses of the second storage unit, wherein the PWM generator includes a first multiplier configured to multiply a value based on an amplitude value included in the first correction data, and a duty value selected from the duty values stored in the first storage unit based on a phase value included in the first correction data; and a second multiplier configured to multiply a value based on an amplitude value included in the second correction data, and a duty value selected from the duty values stored in the second storage unit based on a phase value included in the second correction data.

3. The PWM generating unit as claimed in claim 2, wherein the PWM generator further includes an adder configured to add a multiplication result of the first multiplier, a multiplication result of the second multiplier, and the base duty value, in order to output an added duty value, wherein the adder generates the PWM signal corresponding to the added duty value.

4. The PWM generating unit as claimed in claim 2, further comprising:

a first address counter configured to count the address of the first storage unit;

a second address counter configured to count the address of the second storage unit;

a first register to which a duty value corresponding to the address of the first storage unit counted by the first address counter is set;

a second register to which the value based on the amplitude value included in the first correction data is set;

a third register to which a duty value corresponding to the address of the second storage unit counted by the second address counter is set; and a fourth register to which the value based on the amplitude value included in the second correction data is set, wherein the first multiplier multiplies the value set in the first register to the value set in the second register, and wherein the second multiplier multiplies the value set in the third register to the value set in the fourth register.

5. The PWM generating unit as claimed in claim 4, wherein the first address counter counts the address of the first storage unit for every first time interval, and the second address counter counts the address of the second storage unit for every second time interval.

6. The PWM generating unit as claimed in claim 4, wherein the first address counter counts the address of the first storage unit when a first encoder signal indicating a rotation period of the first rotational body is detected, and the second address counter counts the address of the second storage unit when a second encoder signal indicating a rotation period of the second rotational body is detected.

7. The PWM generating unit as claimed in claim 4, wherein the value set to the second register makes a data width of the multiplication result of the first multiplier equal to a data width of the value set in the first register, and the value set in the fourth register makes a data width of the multiplication result of the second multiplier equal to a data width of the value set in the third register.

8. The PWM generating unit as claimed in claim 4, wherein after a duty value corresponding to a last address of the first storage unit is set to the first register, a duty value corresponding to a first address of the first storage unit is set to the first register, and after a duty value corresponding to a last address of the second storage unit is set to the third register, a duty value corresponding to a first address of the second storage unit is set to the third register.

9. The PWM generating unit as claimed in claim 2, wherein the first storage unit and the second storage unit form a single storage unit.

10. An image forming apparatus comprising:

a photoconductive body configured to form an electrostatic latent image thereon;

a developing unit including a developing roller configured to develop the electrostatic latent image on the photoconductive body;

a first power supply configured to generate a charging bias voltage to charge the photoconductive body;

a second power supply configured to generate a developing bias voltage to be applied to the developing roller; and a PWM generating unit configured to generate a PWM signal to be supplied to at least one of the first power supply and the second power supply, wherein the first power supply generates the charging bias voltage from the PWM signal when supplied with the PWM signal, wherein the second power supply generates the developing bias voltage from the PWM signal when supplied with the PWM signal, and wherein the PWM generating unit includes a base duty setting register configured to store a base duty value that is set thereto; and a PWM generator configured to obtain a corrected duty value by correcting the base duty value based on first correction data and second correction data, and to generate the PWM signal according to the corrected duty value, wherein the first correction data is computed from a rotation period of the photoconductive body, and the second correction data is computed from a rotation period of the developing roller.

11. The image forming apparatus as claimed in claim 10, wherein the PWM generating unit further includes a first storage unit configured to store duty values to be used to correct the base duty value, in correspondence with addresses of the first storage unit; and a second storage unit configured to store duty values to be used to correct the base duty value, in correspondence with addresses of the second storage unit, wherein the PWM generator includes a first multiplier configured to multiply a value based on an amplitude value included in the first correction data, and a duty value selected from the duty values stored in the first storage unit based on a phase value included in the first correction data; and a second multiplier configured to multiply a value based on an amplitude value included in the second correction data, and a duty value selected from the duty values stored in the second storage unit based on a phase value included in the second correction data.

12. An image forming method comprising:

forming an electrostatic latent image on a photoconductive body of an image forming apparatus;

developing the electrostatic latent image on the photoconductive body by a developing unit, including a developing roller, of the image forming apparatus;

generating a PWM signal to be supplied to at least one of a first power supply that generates a charging bias voltage to charge the photoconductive body from the PWM signal when supplied with the PWM signal, and a second power supply that generates a developing bias voltage to be applied to the developing roller from the PWM signal when supplied with the PWM signal, by a PWM generating unit of the image forming apparatus;

wherein the generating includes setting a base duty value to a base duty setting register of the image forming apparatus; and obtaining a corrected duty value by correcting the base duty value based on first correction data and second correction data, and to generate the PWM signal according to the corrected duty value, by a PWM generator of the image forming apparatus, wherein the first correction data is computed from a rotation period of the photoconductive body, and the second correction data is computed from a rotation period of the developing roller.

13. The image forming method as claimed in claim 12, further comprising:

receiving, by an interface unit of the image forming apparatus, the first correction data and the second correction data from an external apparatus that is coupled to the image forming apparatus.

14. An apparatus comprising:

a processing unit configured to compute first correction data from a rotation period of a first rotational body that forms an electrostatic latent image, second correction data from a rotation period of a second rotational body that develops the electrostatic latent image on the first rotational body, and a corrected duty value by correcting a base duty value based on the first correction data and the second correction data; and a PWM generating unit configured to generate a PWM signal according to the corrected duty value, wherein the PWM signal determines at least one of a charging bias voltage to charge the first rotational body and a developing bias voltage to be applied to the second rotational body.

15. A method comprising:

computing, by a processing unit, first correction data from a rotation period of a first rotational body that forms an electrostatic latent image, second correction data from a rotation period of a second rotational body that develops the electrostatic latent image on the first rotational body, and a corrected duty value by correcting a base duty value based on the first correction data and the second correction data; and generating, by a PWM generating unit, a PWM signal according to the corrected duty value, wherein the PWM signal determines at least one of a charging bias voltage to charge the first rotational body and a developing bias voltage to be applied to the second rotational body.

* * * * *